US008870350B2

(12) United States Patent
Suzuki et al.

(10) Patent No.: US 8,870,350 B2
(45) Date of Patent: Oct. 28, 2014

(54) IMAGE FORMING DEVICE, AND IMAGE FORMING METHOD

(75) Inventors: Ryota Suzuki, Tokyo (JP); Takeo Tsukamoto, Kanagawa (JP); Takeshi Orito, Kanagawa (JP); Manabu Seo, Kanagawa (JP); Hideomi Sakuma, Kanagawa (JP); Aino Hasegawa, Kanagawa (JP); Hiroyuki Yamashita, Kanagawa (JP); Yuuma Usui, Kanagawa (JP); Hisayoshi Ohshima, Kanagawa (JP); Takahiko Matsumoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/704,321

(22) PCT Filed: Apr. 12, 2012

(86) PCT No.: PCT/JP2012/060525
§ 371 (c)(1),
(2), (4) Date: Dec. 14, 2012

(87) PCT Pub. No.: WO2012/141335
PCT Pub. Date: Oct. 18, 2012

(65) Prior Publication Data

US 2013/0093810 A1 Apr. 18, 2013

(30) Foreign Application Priority Data

Apr. 15, 2011 (JP) ..... 2011-091414
Dec. 28, 2011 (JP) ..... 2011-289354

(51) Int. Cl.

| | |
|---|---|
| ***B41J 2/06*** | (2006.01) |
| ***B41J 2/005*** | (2006.01) |
| ***B41J 2/045*** | (2006.01) |
| ***B41J 2/115*** | (2006.01) |
| ***B41J 2/385*** | (2006.01) |

(52) U.S. Cl.
CPC ..... *B41J 2/115* (2013.01); *B41J 2/0057* (2013.01); *B41J 2/04581* (2013.01); *B41J 2/3855* (2013.01); *B41J 2/04563* (2013.01)
USPC ..... 347/55; 347/103

(58) Field of Classification Search
CPC ..... B41J 2/0057
See application file for complete search history.

(56) References Cited

U.S. PATENT DOCUMENTS 4,897,665 A 1/1990 Aoki
5,132,706 A 7/1992 Yuasa et al.

(Continued)

FOREIGN PATENT DOCUMENTS

JP H01-130949 5/1989
JP H07-186434 7/1995

(Continued)

OTHER PUBLICATIONS

Machine generated, English translation of JP2010-264697 to Seo et al., "Image Formation Device and Image Forming Method," generated via www4.ipdl.inpit.go.jp.com on Feb. 21, 2014; 11 pp.*

(Continued)

*Primary Examiner* — Shelby Fidler
(74) *Attorney, Agent, or Firm* — Oblon, Spivak, McClelland, Maier & Neustadt, L.L.P.

(57) ABSTRACT

An image forming device includes a head including a nozzle that discharges an electrically-conductive recording liquid in accordance with a driving signal; an intermediate transfer body on which the recording liquid discharged by the head is applied; a voltage apply unit that applies a voltage between the intermediate transfer body and the head, so as to decompose the electrically-conductive recording liquid by electrolysis; a transfer unit that transfers an image supported on the intermediate transfer body onto a recording material; and a discharging control unit that generates the driving signal that causes the electrically-conductive recording liquid to be discharged from the nozzle. The discharging control unit generates the driving signal so that a position of a meniscus is placed outside the nozzle during a time interval in which the recording liquid temporarily bridges between the head and the intermediate transfer body.

16 Claims, 14 Drawing Sheets

(56) References Cited

U.S. PATENT DOCUMENTS

| | | | | |
|---|---|---|---|---|
| 6,068,368 | A * | 5/2000 | Lum et al. | 347/55 |
| 6,257,716 | B1 | 7/2001 | Yanagawa et al. | |
| 6,348,938 | B1 | 2/2002 | Muroi et al. | |
| 6,663,214 | B1 * | 12/2003 | Chen et al. | 347/20 |
| 7,876,345 | B2 | 1/2011 | Houjou | |
| 2002/0135650 | A1 * | 9/2002 | Nagai et al. | 347/100 |
| 2002/0180856 | A1 * | 12/2002 | Koga et al. | 347/100 |
| 2011/0249050 | A1 * | 10/2011 | Ozawa et al. | 347/10 |
| 2011/0273523 | A1 | 11/2011 | Tsukamoto et al. | |
| 2012/0050393 | A1 | 3/2012 | Usui et al. | |

FOREIGN PATENT DOCUMENTS

| | | |
|---|---|---|
| JP | 2724141 | 3/1998 |
| JP | H10-157164 | 6/1998 |
| JP | H10-217477 | 8/1998 |
| JP | H11-188858 | 7/1999 |
| JP | 2008-062397 | 3/2008 |
| JP | 2009-190189 A | 8/2009 |
| JP | 2010-173201 | 8/2010 |
| JP | 2010-188665 | 9/2010 |
| JP | 2010-208147 | 9/2010 |
| JP | 2010-247381 | 11/2010 |
| JP | 2010-253807 | 11/2010 |
| JP | 2010-264697 | 11/2010 |
| JP | 2011-084041 | 4/2011 |
| JP | 2011-148154 | 8/2011 |
| JP | 2011-167885 | 9/2011 |
| JP | 2011-235589 | 11/2011 |
| WO | 2011/142404 A1 | 11/2011 |

OTHER PUBLICATIONS

U.S. Appl. No. 13/697,731, filed Nov. 13, 2012, Suzuki, et al.

U.S. Appl. No. 13/588,748, filed Aug. 17, 2012, Usui, et al.

International Search Report Issued May 29, 2012 in PCT/JP2012/060525 Filed on Apr. 12, 2012.

Office Action issued May 14, 2014 in Korean Patent Application No. 10-2012-7032501.

Supplementary European Search Report issued Jul. 23, 2014, in European Application No. EP 12 77 1529.

* cited by examiner

IMAGE FORMING DEVICE, AND IMAGE FORMING METHOD

TECHNICAL FIELD

Embodiments of the present invention are related to an inkjet image forming device that forms an image by applying a recording liquid, such as ink, onto an intermediate transfer body through a head, and an image forming method using the inkjet image forming device.

BACKGROUND ART

An inkjet image forming device, such as an inkjet printer, has conventionally been known, which includes a head that forms and discharges the liquid droplets of a recording liquid, such as ink, through plural microscopic nozzles, based on a method using a movable actuator, such as a piezoelectric method, or a heating film-boiling method, such as a thermal method (cf. Patent Document 1 (Japanese Published Unexamined Application No. H01-130949) and Patent Document 2 (Japanese Registered Patent No. 2724141)), and which performs inkjet recording (cf., Patent Document 3 (Japanese Published Unexamined Application No. 2008-062397), Patent Document 4 (Japanese Published Unexamined Application No. H11-188858), and Patent Document 5 (Japanese Published Unexamined Application No. 2010-188665)).

In the inkjet method, with a configuration in which the recording liquid from the head is directly applied onto a recording material, such as a recording paper, since the head and the recording material are adjacent to each other, paper dust and dust that adhere to the recording material tend to adhere to the nozzles. When the paper dust adheres to the nozzles, flying directions of the droplets discharged from the nozzles may be perturbed and the nozzles may be clogged. Thus the image quality and the reliability are lowered. As a method of circumventing such a problem, usually discharging stability of the nozzles is given priority, and a recording liquid having a low viscosity is utilized. However, when droplets of the recording liquid having the low viscosity adhere onto the recording material, the droplets tend to be blurred.

Accordingly, an image forming device having an intermediate transfer body has been proposed. Namely, the image forming device includes the intermediate transfer body that supports droplets of a recording liquid discharged from a head. In the image forming device, an image is formed on the intermediate transfer body, and subsequently the image is transferred onto a recording material (cf. Patent Documents 3 through 5).

Further, an image forming device having a process liquid applying unit has been proposed. Here, the image forming device also includes the intermediate transfer body. The process liquid applying unit is for applying a process liquid that changes the pH level of the recording liquid onto the intermediate transfer body (cf. Patent Document 3). In the image forming device, the recording liquid is formed of a solvent which consists of a mixture of water and a water soluble solvent, in which at least pigments and polymer particles are dispersed. Here, the pigments and the polymer particles are condensed, when the pH level is changed.

Further, another image forming device having the intermediate transfer body has been proposed. Here, powders that absorb the droplets of the recording paper are adhered on the intermediate transfer body, so as to reduce the blurs (cf. Patent Document 4).

Further, another image forming device having the intermediate transfer body has been proposed. Namely, in the proposed image forming device, in order to address the problem of the blurring, a bridge, which is a liquid column of an electrically-conductive recording liquid, is temporarily formed between a nozzle and the intermediate transfer body and a voltage is applied to the liquid column, so that the water included in the bridge is decomposed by electrolysis (cf. Patent Document 5).

However, the image forming devices, in which the process liquid or the powders are adhered to the intermediate transfer body (cf. Patent Documents 3 and 4), have a problem that the printing speed is reduced due to the adherence of the process liquid or the powders, and a problem that the image forming devices increase in size. Further, with the configuration in which the powders are adhered to the intermediate transfer body, the powders tend to adhere to the nozzles, and the discharging performance of the head to discharge the recording liquid tends to be lowered. Therefore, the problem that the printing speed is reduced and the problem that the image forming devices increase in size may be required to be resolved, while ensuring the discharging performance of the head to discharge the recording liquid.

On the other hand, for the image forming device that temporarily forms the bridge of the liquid column of the electrically-conductive recording liquid between the nozzle and the intermediate transfer body and that applies the voltage to the bridge, so that the water included in the bridge is decomposed by electrolysis (cf. Patent Document 5), there is an advantage that the processing liquid other than the recording liquid and the powder may be not required.

In such an image forming device, in order to suppress the blurring, it is preferable that the recording liquid of the liquid column be sufficiently decomposed by electrolysis. However, when a very high voltage is applied between the nozzle and the intermediate transfer body, so as to facilitate the electrolysis, the required power may increase and the recording liquid may be scattered. Further, when the electric conductivity of the recording liquid is increased, so as to facilitate the electrolysis, the dispersion stability of the pigments may be degraded by the large amount of electrolytes.

An objective of the embodiments is to provide an image forming device that forms images by applying a recording liquid onto an intermediate transfer body through a head. Here, the image forming device can suppress blurring of droplets of the recording liquid without adding a process liquid or powders other than the recording liquid, while ensuring the discharging performance of the head to discharge the recording liquid. Further, the image forming device can suppress the blurring of the droplets of the recording liquid by ensuring that the recording liquid is decomposed by electrolysis without utilizing a high voltage or a large amount of electrolytes. Another objective of the embodiments is to provide an image forming method in which the image forming device is utilized.

SUMMARY OF THE INVENTION

Means for Solving the Problems

In one aspect, there is provided an image forming device including a head having a nozzle that discharges an electrically-conductive recording liquid in accordance with a driving signal; an intermediate transfer body on which the recording liquid discharged by the head is applied, at least a surface of the intermediate transfer body being electrically conductive; a voltage apply unit that applies a voltage between the intermediate transfer body and the head, so as to decompose the electrically-conductive recording liquid by electrolysis, wherein the electrically-conductive recording liquid is discharged from the head and is in a state in which the recording liquid temporarily bridges between the head and the intermediate transfer body; a transfer unit that transfers an image formed of the electrically-conductive recording liquid and supported on the intermediate transfer body onto a recording material; and a discharging control unit that generates the driving signal that causes the electrically-conductive recording liquid to be discharged from the nozzle. The discharging control unit generates the driving signal so that a position of a meniscus is placed outside the nozzle during a time interval in which the recording liquid is in the state.

In another aspect, there is provided an image forming method that utilizes a head including a nozzle that discharges an electrically-conductive recording liquid in accordance with a driving signal; an intermediate transfer body on which the recording liquid discharged by the head is applied, at least a surface of the intermediate transfer body being electrically conductive; a voltage apply unit that applies a voltage between the intermediate transfer body and the head, so as to decompose the electrically-conductive recording liquid by electrolysis, wherein the electrically-conductive recording liquid is discharged from the head and is in a state in which the recording liquid temporarily bridges between the head and the intermediate transfer body; a transfer unit configured to transfer an image formed of the electrically-conductive recording liquid and supported on the intermediate transfer body onto a recording material; and a discharging control unit configured to generate the driving signal that causes the electrically-conductive recording liquid to be discharged from the nozzle. Here, an image is formed by generating the driving signal by the discharging control unit so that a position of a meniscus is placed outside the nozzle during a time interval in which the state is formed.

According to the embodiment, the image forming device includes the head having the nozzles that discharge the electrically-conductive recording liquid in accordance with the driving signal; the intermediate transfer body on which the electrically-conductive recording liquid is applied by the head, at least the surface of the intermediate transfer body being electrically conductive; the voltage apply unit that applies the voltage between the intermediate transfer body and the head, so that the electrically-conductive recording liquid is decomposed by the electrolysis, the electrically-conductive recording liquid being discharged from the head and in the state in which the electrically-conductive recording liquid temporarily bridges between the head and the intermediate transfer body; the transfer unit that transfers the image formed of the electrically-conductive recording liquid and supported on the intermediate transfer body onto the recording material; and the discharging control unit that generates the driving signal for discharging the electrically-conductive recording liquid through the nozzles. The discharging control unit in the image forming device generates the driving signal that causes the position of the meniscus to be placed at the outer side of the nozzle, during the formation of the state. Therefore, the image forming device can suppress the blurring of the droplets of the electrically-conductive recording liquid by decomposing the electrically-conductive recording liquid by the electrolysis, while the position of the meniscus is placed at the outer side of the nozzle when the bridge of the electrically-conductive recording liquid is formed. Here, the process liquid or the powders other than the electrically-conductive recording liquid are not added, and the discharging performance of the head to discharge the electrically-conductive recording liquid is ensured. Further, the image forming device can suppress the blurring of the droplets of the electrically-conductive recording liquid by ensuring the decomposition of the electrically-conductive recording liquid by the electrolysis, without utilizing a high voltage or a large amount of electrolytes. Therefore, an image forming device can be provided, which can reduce the energy consumption, the running cost, and the resources. In addition, the image forming device can form high quality images.

When the discharging control unit generates the first driving signal for forming the state and the second driving signal for additionally discharging the electrically-conductive recording liquid through the nozzles in the state formed by the first driving signal, the discharging performance of the head to discharge the electrically-conductive recording liquid is ensured and, at the same time, the blurring of the droplets of the electrically-conductive recording liquid can be highly suppressed by decomposing the electrically-conductive recording liquid while the electrically-conductive recording liquid is additionally discharged by the second driving signal, without adding the process liquid and the powders other than the conductive recording liquid. Further, the blurring of the droplets of the electrically-conductive recording liquid can be suppressed by ensuring the decomposition of the electrically-conductive recording liquid by the electrolysis, without utilizing a high voltage or a large amount of electrolytes. Therefore, an image forming device can be provided, which can reduce the energy consumption, the running cost, and the resources, and which can form high quality images.

When the discharging control unit generates the second driving signal that causes the electrically-conductive recording liquid that has been discharged from the nozzle to return to the nozzle, the discharging performance of the head to discharge the electrically-conductive recording liquid is ensured and, at the same time, the blurring of the droplets of the electrically-conductive recording liquid can be highly suppressed by decomposing the electrically-conductive recording liquid while the electrically-conductive recording liquid is additionally discharged by the second driving signal, without adding the process liquid and the powders other than the conductive recording liquid. Further, the blurring of the droplets of the electrically-conductive recording liquid can be suppressed by ensuring the decomposition of the electrically-conductive recording liquid by the electrolysis, without utilizing a high voltage or a large amount of electrolytes. Therefore, an image forming device can be provided, which can reduce the energy consumption, the running cost, and the resources, and which can form high quality images.

When the discharging control unit adjusts the time interval between the first driving signal and the second driving signal such that the time interval is equal to an integral multiple of the oscillation period, the discharging performance of the head to discharge the electrically-conductive recording liquid is ensured and, at the same time, the blurring of the droplets of the electrically-conductive recording liquid can be highly suppressed by decomposing the electrically-conductive recording liquid while the electrically-conductive recording liquid is additionally discharged at proper timings by the second driving signal, without adding the process liquid and the powders other than the conductive recording liquid. Further, the blurring of the droplets of the electrically-conductive recording liquid can be suppressed by ensuring the decomposition of the electrically-conductive recording liquid by the electrolysis, without utilizing a high voltage or a large amount of electrolytes. Therefore, an image forming device can be provided, which can reduce the energy consumption, the running cost, and the resources, and which can form high quality images.

When the discharging control unit adjusts the time interval between the first driving signal and the second driving signal such that the time interval is equal to the oscillation period, the discharging performance of the head to discharge the electrically-conductive recording liquid is ensured and, at the same time, the blurring of the droplets of the electrically-conductive recording liquid can be highly suppressed by decomposing the electrically-conductive recording liquid while the electrically-conductive recording liquid is additionally discharged at the most proper timings by the second driving signal, without adding the process liquid and the powders other than the conductive recording liquid. Further, the blurring of the droplets of the electrically-conductive recording liquid can be suppressed by ensuring the decomposition of the electrically-conductive recording liquid by the electrolysis, without utilizing a high voltage or a large amount of electrolytes. Therefore, an image forming device can be provided, which can reduce the energy consumption, the running cost, and the resources, and which can form high quality images.

When the head includes a temperature measurement unit that measures the head or the temperature in the vicinity of the head and the discharging control unit generates the driving signal based on the temperature measured by the temperature measurement unit, the discharging performance of the head to discharge the electrically-conductive recording liquid is secured and, at the same time, the blurring of the droplets of the electrically-conductive recording liquid can be highly suppressed by reducing the unevenness in the degree of the blurring by decomposing the electrically-conductive recording liquid by the electrolysis using the driving signal that is adapted for the physical property change of the electrically-conductive recording liquid, which is associated with the change of the environment, in the state in which the position of the meniscus, at the time of forming the bridge with the electrically-conductive recording liquid, is at the outer side of the nozzle, without adding the process liquid and the powders other than the conductive recording liquid. Further, the blurring of the droplets of the electrically-conductive recording liquid can be suppressed by ensuring the decomposition of the electrically-conductive recording liquid by the electrolysis, without utilizing a high voltage or a large amount of electrolytes. Therefore, an image forming device can be provided, which can reduce the energy consumption, the running cost, and the resources, and which can form high quality images.

When the image forming device includes the electric current measurement unit that measures the electric current that flows across the electrically-conductive recording liquid in the state and the discharging control unit generates the driving signal based on the electric current measured by the electric current measurement unit, the discharging performance of the head to discharge the electrically-conductive recording liquid is secured and, at the same time, the blurring of the droplets of the electrically-conductive recording liquid can be highly suppressed by reducing the unevenness in the degree of the blurring by decomposing the electrically-conductive recording liquid using the driving signal which is generated based on the electric current measured at the time of forming the bridge, so that the driving signal is generated with the feedback corresponding to the discharging state in real time at the time of forming the bridge, in the state in which the position of the meniscus, at the time of forming the bridge with the electrically-conductive recording liquid, is at the outer side of the nozzle, without adding the process liquid and the powders other than the conductive recording liquid. Further, the blurring of the droplets of the electrically-conductive recording liquid can be suppressed by ensuring the decomposition of the electrically-conductive recording liquid by the electrolysis, without utilizing a high voltage or a large amount of electrolytes. Therefore, an image forming device can be provided, which can reduce the energy consumption, the running cost, and the resources, and which can form high quality images.

When the electrically-conductive recording liquid includes water as a solvent and the pigments are dispersed in the electrically-conductive recording liquid by an anionic dispersant, and when the intermediate transfer body functions as an anode during the application of the voltage by the voltage application unit, the discharging performance of the head to discharge the electrically-conductive recording liquid is ensured and, at the same time, the blurring of the droplets of the electrically-conductive recording liquid is highly suppressed by decomposing the electrically-conductive recording liquid in the state in which the position of the meniscus at the time of forming the bridge with the electrically-conductive recording liquid, is at the outer side of the nozzle, without adding the process liquid or the powders other than the electrically-conductive recording liquid. Further, the blurring of the droplets of the electrically-conductive recording liquid can be suppressed by ensuring the decomposition of the electrically-conductive recording liquid by the electrolysis, without utilizing a high voltage or a large amount of electrolytes. Therefore, an image forming device can be provided, which can reduce the energy consumption, the running cost, and the resources, and which can form high quality images.

According to the embodiment, in the image forming method, the following units are utilized. Namely, the head having the nozzles that discharge the electrically-conductive recording liquid in accordance with the driving signal; the intermediate transfer body on which the electrically-conductive recording liquid is applied by the head, at least the surface of the intermediate transfer body being electrically conductive; the voltage apply unit that applies the voltage between the intermediate transfer body and the head, so that the electrically-conductive recording liquid is decomposed by the electrolysis, the electrically-conductive recording liquid being discharged from the head and in the state in which the electrically-conductive recording liquid temporarily bridges between the head and the intermediate transfer body; the transfer unit that transfers the image formed of the electrically-conductive recording liquid and supported on the intermediate transfer body onto the recording material; and the discharging control unit that generates the driving signal for discharging the electrically-conductive recording liquid through the nozzles are utilized. Thus the discharging performance of the head to discharge the electrically-conductive recording liquid is ensured and, at the same time, the blurring of the droplets of the electrically-conductive recording liquid is highly suppressed by decomposing the electrically-conductive recording liquid by the electrolysis, in the state in which the position of the meniscus, at the time of forming the bridge with the electrically-conductive recording liquid, is at the outer side of the nozzle, without adding the process liquid or the powders other than the electrically-conductive recording liquid. Further, the blurring of the droplets of the electrically-conductive recording liquid can be suppressed by ensuring the decomposition of the electrically-conductive recording liquid by the electrolysis, without utilizing a high voltage or a large amount of electrolytes. Therefore, an image forming device can be provided, which can reduce the energy consumption, the running cost, and the resources, and which can form high quality images.

DESCRIPTION OF THE REFERENCE NUMERALS

Figure 1:
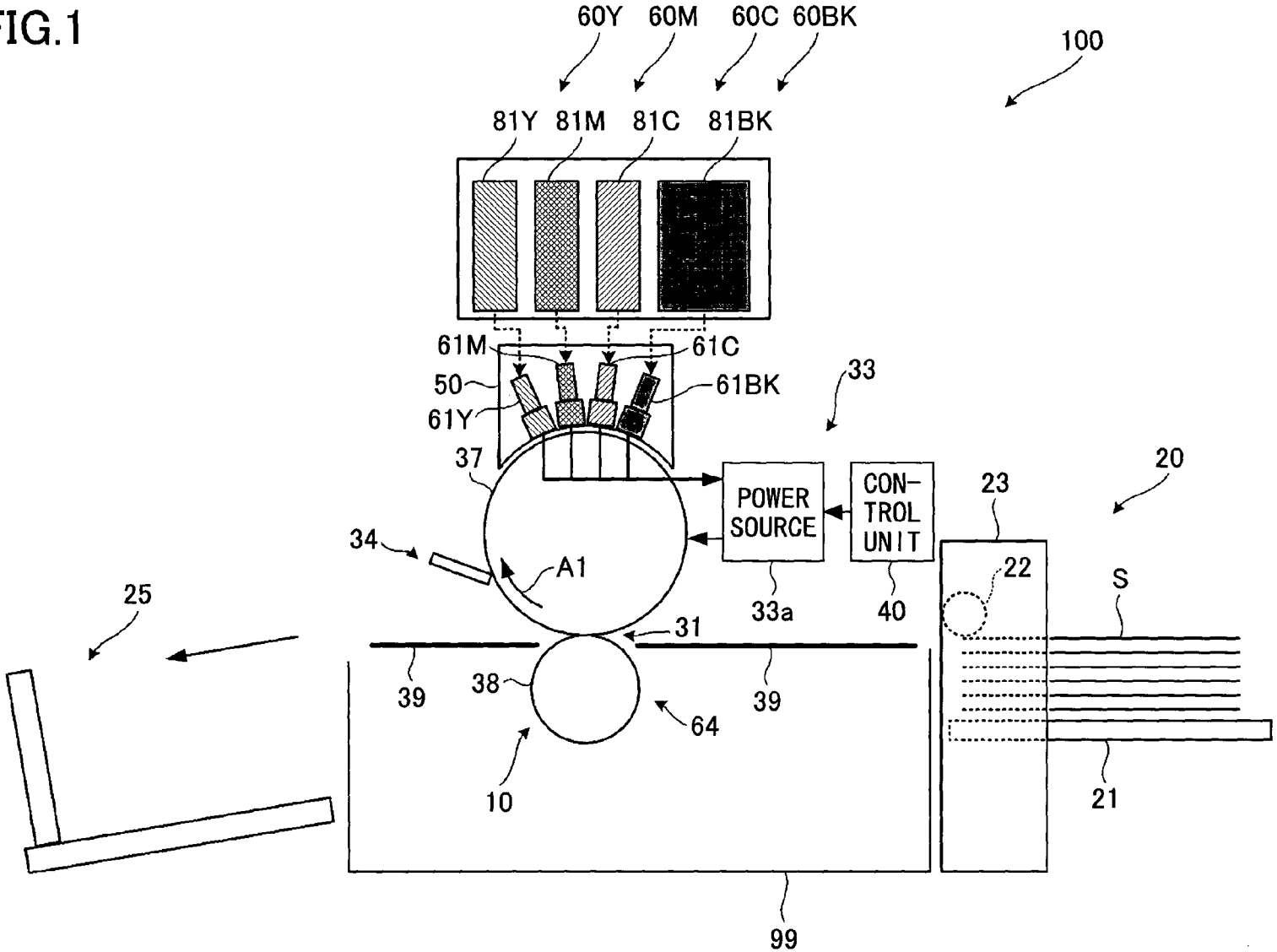
FIG. 1 is a schematic front view of an image forming device according to an embodiment.

33 Voltage apply unit
35 Current sensor
37 Intermediate transfer body
40 Discharging control unit
61*b* Nozzle
61Y, 61M, 61C, 61BK Heads
62 Temperature measurement unit
64 Transfer unit
100 Image forming device
S Recording material

MODE FOR CARRYING OUT THE INVENTION

FIG. 1 is a schematic diagram of an image forming device 100 according to an embodiment. The image forming device 100 is an inkjet printer that can form a full-color image. The image forming device 100 forms an image based on an image signal corresponding to image information received from outside the image forming device 100.

The image forming device 100 can form an image on a sheet-shaped recording medium formed of a transparency, a card, a cardboard, such as a postcard or an envelope, in addition to a plain paper that is commonly used for copying. The image forming device 100 is a one-sided image forming device that can form an image on one side of a transfer paper S. Here, the transfer paper S is a recording medium, which is a paper sheet that is a material to be recorded on. However, the image forming device 100 may be a double-sided image forming device that can form images on both side of the transfer paper S.

The image forming device 100 includes heads 61Y, 61M, 61C, and 61BK, as recording heads. The heads 61Y, 61M, 61C, and 61BK are ink heads that are recording liquid discharging bodies that discharge corresponding electrically-conductive recording liquids (recording liquids), that are a yellow ink, a magenta ink, a cyan ink, and a black ink. The heads 61Y, 61M, 61C, and 61BK can form a yellow image, a magenta image, a cyan image, and a black image, respectively. Here, the yellow image, the magenta image, the cyan image, and the black image are obtained by decomposing an original image into the corresponding colors.

The heads 61Y, 61M, 61C, and 61BK are arranged at corresponding positions facing an outer circumferential surface of an intermediate transfer body 37. Here, the intermediate transfer body 37 is an intermediate transfer drum arranged at a substantially central portion of a main body 99 of the image forming device 100. The heads 61Y, 61M, 61C, and 61BK are arranged in this order from an upstream side in a moving direction of the intermediate transfer body 37. Here, as shown in FIG. 1, the moving direction of the intermediate transfer body 37 is the direction indicated by A1, which is the clockwise direction. In FIG. 1, the symbols Y, M, C, and BK following the reference numerals indicate that the corresponding elements are for the colors of yellow, magenta, cyan, and black.

The heads 61Y, 61M, 61C, and 61BK are included in ink discharging devices 60Y, 60M, 60C, and 60BK, respectively. Here, the ink discharging device 60Y, 60M, 60C, and 60BK are recording liquid discharging devices for forming a yellow (Y) image, a magenta (M) image, a cyan (C) image, and a black (BK) image, respectively. Incidentally, plural heads 61Y are arranged in the direction perpendicular to the surface of the paper of FIG. 1, and included in the ink discharging device 60Y. Similarly, plural heads 61M, plural heads 61C, and plural heads 61BK are arranged in the direction perpendicular to the surface of the paper of FIG. 1, and included in the corresponding ink discharging devices 60M, 60C, and 60BK.

An image is formed on the surface of the intermediate transfer body 37. During the formation of the image, the yellow recording liquid is discharged from the head 61Y onto an area facing the head 61Y, the magenta recording liquid is discharged from the head 61M onto an area facing the head 61M, the cyan recording liquid is discharged from the head 61C onto an area facing the head 61C, and the black recording liquid is discharged from the head 61BK onto an area facing the head 61BK, while the intermediate transfer body 37 is rotating in the A1 direction, so that the yellow, magenta, cyan, and black recording liquids are sequentially applied and superposed. As described above, the image forming device 100 has a tandem structure such that the heads 61Y, 61M, 61C, and 61BK are facing the intermediate transfer body 37 and aligned in the A1 direction.

The head 61Y, 61M, 61C, and 61BK discharge (apply) the corresponding recording liquids onto the intermediate transfer body 37 from the upstream side to the downstream side in the A1 direction at different timings, so that a yellow image area, a magenta image area, a cyan image area, and a black image area are superposed at the same position on the intermediate transfer body 37.

The image forming device 100 includes the ink discharging devices 60Y, 60M, 60C, and 60BK; a conveyance unit 10; a paper feed unit 20; and a paper discharge table 25. Here, the ink discharging devices 60Y, 60M, 60C, and 60BK include the heads 61Y, 61M, 61C, and 61BK, respectively. The conveyance unit 10 includes the intermediate transfer body 37. The conveyance unit 10 is a paper conveyance unit in which the transfer paper S is conveyed in accordance with the rotation of the intermediate transfer body 37 in the A1 direction. Many sheets of the transfer paper S can be stacked on the paper feed unit 20. The paper feed unit 20 only transfers one of the sheets of the transfer paper S that is placed at the uppermost position, toward the conveyance unit 10. Many sheets of the transfer paper S that have been conveyed by the conveyance unit 10 can be stacked on the paper discharge table 25. Here, the images have been formed on the sheets of the transfer paper 25. In other words, the printing has been completed for the sheets of the transfer paper 25.

The image forming device 100 also includes a voltage apply unit 33. The voltage apply unit 33 applies a voltage to inside the yellow recording liquid while the yellow recording liquid is in a state in which a liquid column formed of the yellow recording liquid temporarily bridges between the head 61Y and the intermediate transfer body 37, immediately after the yellow recording liquid is discharged from the head 61Y as shown in FIG. 2B, so that a voltage difference is formed between the intermediate transfer body 37 and the head 61Y. Similarly, the voltage apply unit 33 applies the voltage to inside the magenta, cyan, and black recording liquids while the magenta, cyan, and black recording liquids are in corresponding states in which liquid columns formed of the magenta, cyan, and black recording liquids temporarily bridge between the intermediate transfer body 37 and the recording heads 61M, 61C, and 61BK, immediately after the magenta, cyan, and black recording liquids are discharged from the heads 61M, 61C, and 61BK, respectively, as shown in FIG. 2B, so that the voltage difference is formed between the intermediate transfer body 37 and the heads 61M, 61C, and 61BK. Here, the electric currents include electric current components caused by the electrode oxidation reactions or the electrode reduction reactions. The voltage apply unit 33 is a voltage applying unit that facilitates condensation of pigments (described later) included in the recording liquids in the above described states, or that facilitates increasing the viscosity of the recording liquids.

Figure 2A:
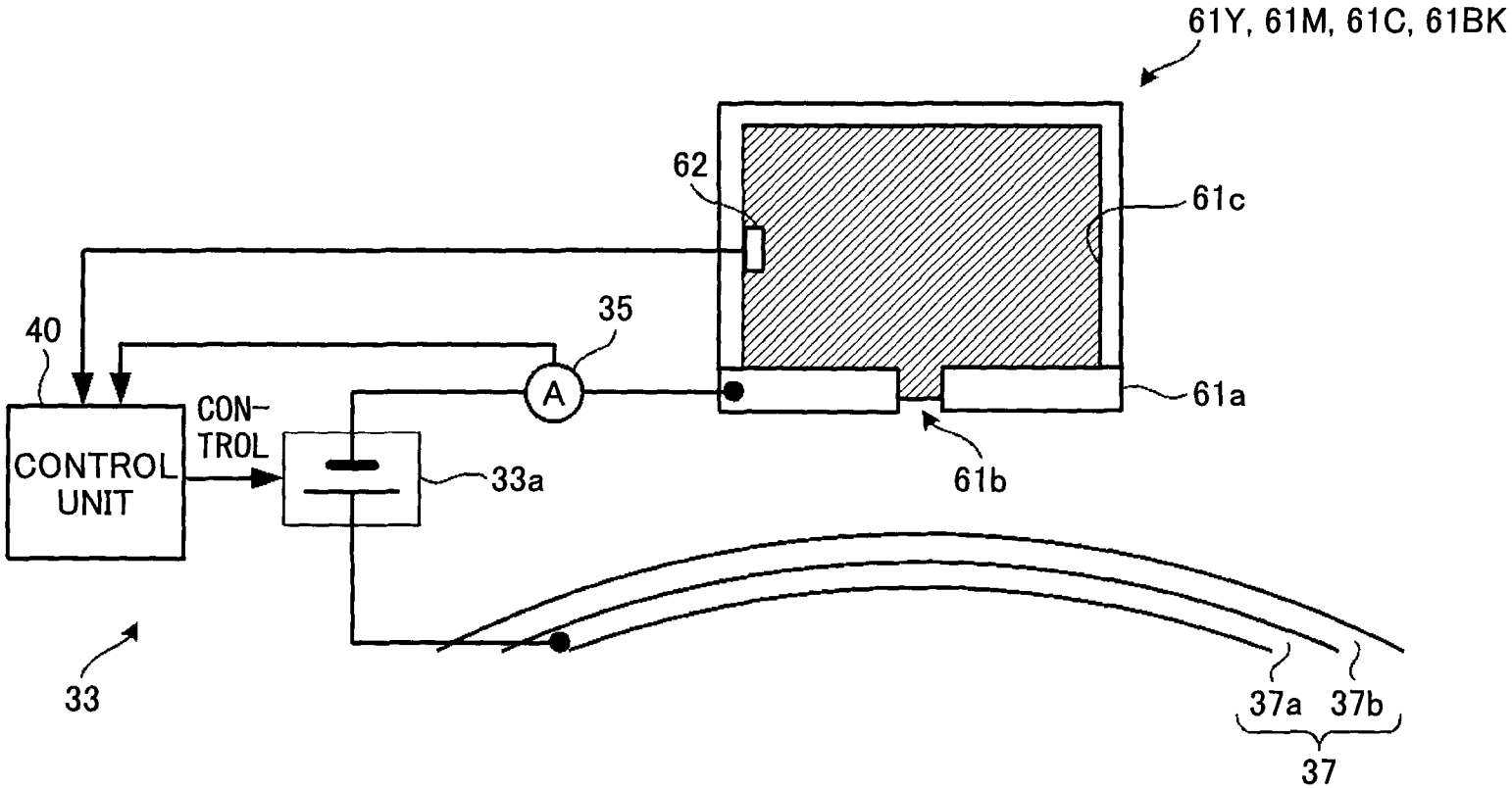
FIGS. 2A-2C are schematic diagrams illustrating a situation during which an electrically-conductive recording liquid is applied to an intermediate transfer body from a head in the image forming device shown in FIG. 1.
Figure 2B:
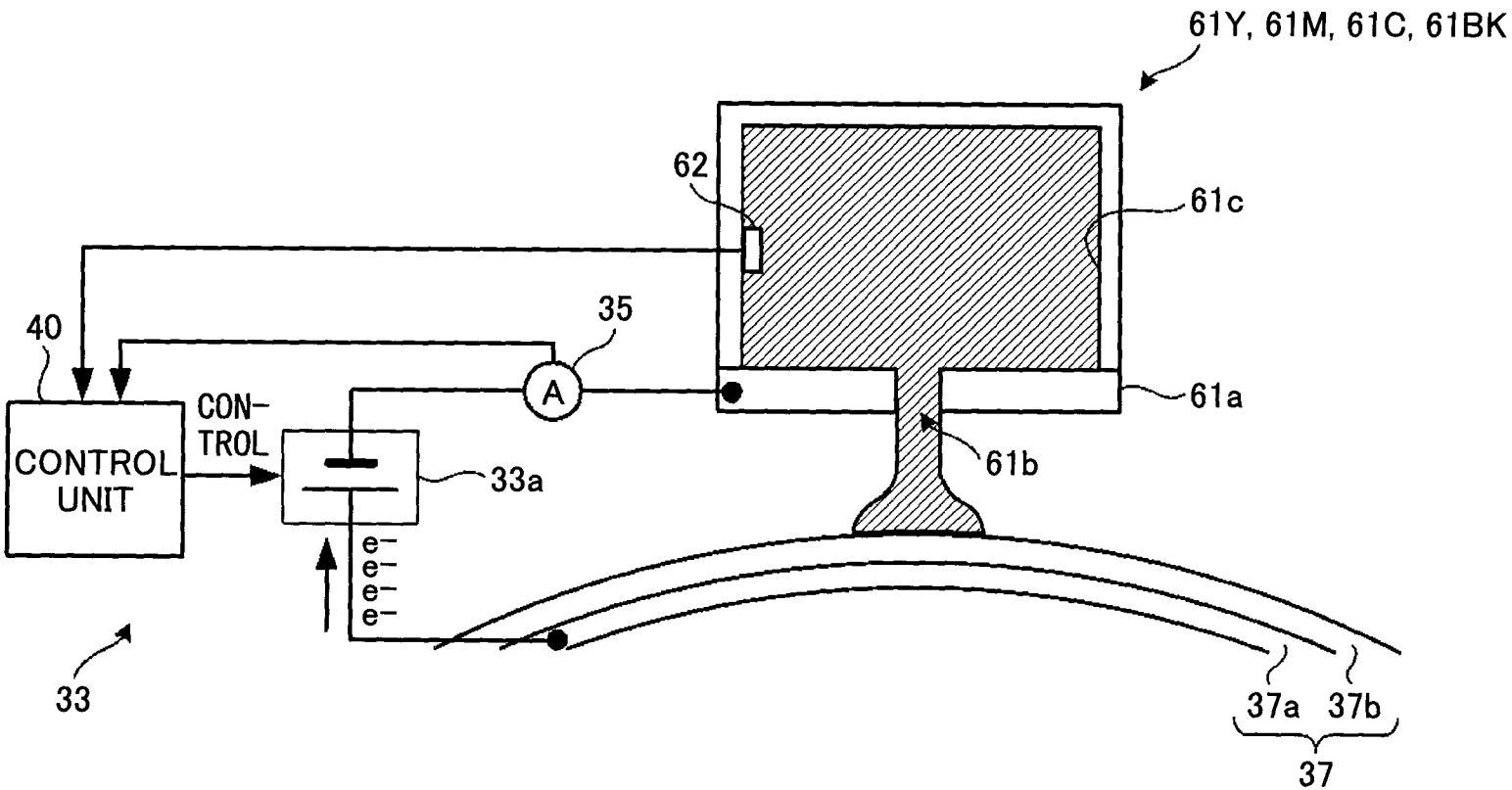
Figure 2C:
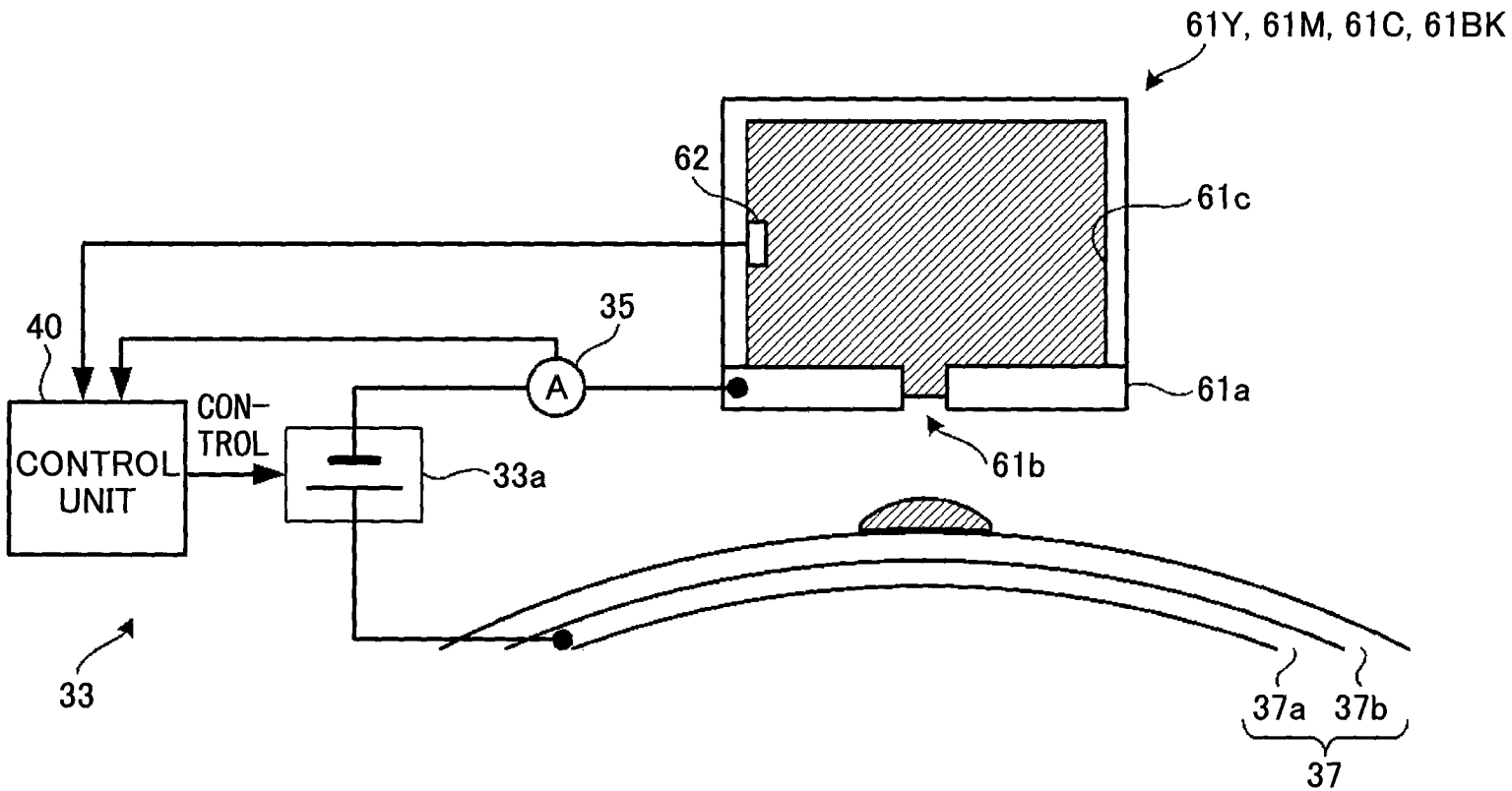

Further, as shown in FIGS. 2A-2C, the image forming device 100 includes temperature sensors 62. The temperature sensors 62 are temperature measuring devices that measure temperatures of the corresponding heads 61Y, 61M, 61C, and 61BK.

As shown in FIG. 1, the image forming device 100 further includes a cleaning unit 34, a carriage 50, and a control unit 40. Here, the cleaning unit 34 is for cleaning the intermediate transfer body 37, after the recording liquids are transferred onto the transfer paper S, so as to remove the recording liquids and the like remaining on the intermediate transfer body 37. The carriage 50 is a head supporting body that integrally supports the heads 61Y, 61M, 61C, and 61BK. The control unit 40 includes a CPU that controls the whole operations of the image forming device 100, and a memory.

The conveyance unit 10 includes a transfer unit 64, a guide plate 39, and a motor (not shown), in addition to the intermediate transfer body 37. The transfer unit 64 transfers an image formed of the recording liquids, which is supported on the intermediate transfer body 37, onto the transfer paper S, while the transfer paper S is passing through a transfer region 31 that is placed to face the intermediate transfer body 37 and that is a space between the intermediate transfer body 37 and a transfer roller 38. The guide plate 39 guides the transfer paper S fed from the paper feed unit 20 to the transfer region 31. Additionally, the guide plate 39 guides the transfer paper S, which has been passed through the transfer region 31, to the paper discharge table 25. The motor rotationally drives the intermediate transfer body 37 in the A1 direction. As described above, the image forming device 100 adopts an indirect method in which an image is indirectly formed on the transfer paper S using the intermediate transfer body 37.

The transfer unit 64 includes the transfer roller 38 that is rotationally driven by the intermediate transfer body 37. Here, the transfer roller 38 may include a built-in heater for fixing an image, which is transferred onto the transfer paper S, to the transfer paper S. Further, the conveyance unit 10 may include a fixing roller for fixing an image, which has been transferred from the intermediate transfer body 37 onto the transfer paper S by the transfer roller 38, to the transfer paper S.

As shown in FIGS. 2A-2C, the intermediate transfer body 37 includes a support body 37*a* and a surface layer 37*b*. Here, the support body 37*a* is a conductive substrate and is made of aluminum. The surface layer 37*b* is formed on the support body 37*a* and is made of silicone rubber. The material of the support body 37*a* is not limited to aluminum. For example, the support body 37*a* may be formed of a metal, such as an aluminum alloy, copper, or a stainless steel, provided that the metal has sufficient mechanical strength. The material of the surface layer 37*b* is not limited to silicone rubber. An elastic material having low surface energy and high followability to the transfer paper S may be used as the material of the surface layer 37*b*, since such an elastic material has high detachability. For example, the surface layer 37*b* may be formed of a material such as urethane rubber, fluororubber, or nitrile butadiene rubber.

The surface layer 37*b* is an electrically-conductive layer formed of an electrically-conductive rubber, which is formed of a rubber material in which fine particles of carbon, platinum, or gold are dispersed as a conducting agent, so as to add electric conductivity to the intermediate transfer body 37. However, there is a trade-off such that, when the electrically-conductive fine particles are increased, the electric conductivity of the surface layer 37*b* increases, whereas the detachability of the surface layer 37*b* is lowered. Thus the amount of the electrically-conductive fine particles may be properly adjusted. As described later, in order to apply a desired voltage to the liquid columns formed of the recording liquids that temporarily bridge between the heads 61Y, 61M, 61C, and 61BK and the intermediate transfer body 37, it is preferable that volume resistivity of the electrically-conductive rubber be less than $10^3$ Ωcm. Further, it is desirable that the volume resistivity of the electrically-conductive rubber be less than that of the recording liquids.

The thickness of the surface layer 37*b* may be within a range from 0.1 mm to 1 mm, and it is preferable that the thickness of the surface layer 37*b* be within a range from 0.2 mm to 0.6 mm. Here, the surface layer 37*b* is not an essential component. For example, the intermediate transfer body 37 may only include the support body 37*a*. Further, the intermediate transfer body 37 is not limited to have the drum shape. The intermediate transfer body 37 may be formed as an endless belt. Further, the intermediate transfer body 37 may have a sheet-like shape.

As shown in FIG. 1, the paper feed unit 20 includes, at least, a paper feed tray 21, a paper feed roller 22, a chassis 23, and a motor (not shown). Many sheets of the transfer paper S may be stacked on the paper feed tray 21. The paper feed roller 22 feeds only the uppermost sheet of the transfer paper S among the sheets of the transfer paper S stacked on the paper feed tray 21. The chassis 23 supports the paper feed tray 21 and the paper feed roller 22. The motor rotationally drives the paper feed roller 22 to feed the transfer paper S, while synchronizing the rotation of the feed roller with the timings for discharging the corresponding recording liquids from the heads 61Y, 61M, 610, and 61BK.

The carriage 50 together with the heads 61Y, 61M, 61C, and 61BK is detachably attached to the main body 99, so that the carriage 50 may be replaced with a new one, when, for example, the heads 61Y, 61M, 61C, and/or 61BK are degenerated, and so as to ease the maintenance. The heads 61Y, 61M, 61C, and 61BK are individually detachably attached to the main body 99, so that each of the heads 61Y, 61M, 61C, and 61BK is replaced with a new one, when, for example, the head is degenerated, and so as to ease the maintenance. In this manner, replacement and maintenance are facilitated.

The ink discharging devices 60Y, 60M, 60C, and 60BK are different from each other in the point that the colors of the recording liquids utilized for the ink discharging devices 60Y, 60M, 60C, and 60BK are different. Except for that point, the ink discharging devices 60Y, 60M, 60C, and 60BK have substantially the same configurations. In the ink discharging device 60Y, the plural heads 61Y are arranged in the main scanning direction. Similarly, in the ink discharging device 60M, 60C, and 60BK, the plural heads 61M, 61C, and 61BK are arranged in the main scanning direction, respectively. Therefore, the image forming device 100 together with the ink discharging devices 60Y, 60M, 60C, and 60BK is a full-line type image forming device having fixed heads.

The ink discharging devices 60Y, 60M, 60C, and 60BK include corresponding ink cartridges 81Y, 81M, 81C, and 81BK, corresponding pumps (not shown), and corresponding distributor tanks (not shown). The ink cartridges 81Y, 81M, 810, and 81BK are main tanks that store the recording liquids in the corresponding colors that are supplied to the corresponding heads 61Y, 61M, 61C, and 61BK. The pumps supply the recording liquid stored in the corresponding ink cartridges 81Y, 81M, 81C, and 81BK to the corresponding heads 61Y, 61M, 61C, 61BK. The distributor tanks distribute the recording liquids supplied from the corresponding ink cartridges 81Y, 81M, 81C, and 81BK to the corresponding heads 61Y, 61M, 61C, and 61BK.

The ink discharging devices 60Y, 60M, 60BK further include corresponding ink amount detection sensors (not shown); corresponding first pipes (not shown) that together with the pumps form corresponding first supply channels for the recording liquids between the ink cartridges 81Y, 81M, 81C, and 81BK and the distributor tanks; and corresponding second pipes (not shown) that form corresponding second supply channels for the recording liquids between the distributor tanks and the heads 61Y, 61M, 61C, and 61BK. The ink amount detection sensors detect amounts of the corresponding recording liquids in the corresponding distributor tanks, so as to detect shortages of the corresponding recording liquids in the corresponding distributor tanks.

The ink cartridges 81Y, 81M, 81C, and 81BK are detachably attached to the main body 99, so that each of the ink cartridges 81Y, 81M, 81C, and 81BK can be replaced with a new one, when, for example, the recording liquid inside the ink cartridge is running short, and so as to ease the maintenance.

The operations of the pumps are controlled by the control unit 40. Specifically, if shortages of the recording liquids in the corresponding distributor tanks are detected by the ink amount detection sensors, the pumps are driven until the shortages are not detected, so as to supply the recording liquids in the ink cartridges 81Y, 81M, 81C, and 81BK to the distributor tanks. In this regard, the control unit 40 functions as an ink supply control unit, which is a recording liquid supply control unit. Even in cases that are not specifically explained, the control unit 40 controls operations of the components in the image forming device 100, provided that the components are driven in the image forming device 100.

The recording liquids include colorants corresponding to yellow, magenta, cyan, and black; anionic dispersing agents that disperse the corresponding colorants; and solvents. Because of the colorants and the dispersing agents, the ink components in the corresponding recording liquids have anionic groups. The solvents include water for the safety and for the conductivity for causing the electrolysis (described later). Each of the recording liquids is water-soluble recording liquid that is electrically-conductive ink and at the same time water-soluble ink. Further, it is preferable that the recording liquids be alkaline for the preserving stability.

Pigments utilized as the colorants in the recording liquids are not particularly limited. However, as an orange or a yellow pigment, the following may be considered: C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, C.I. Pigment Yellow 128, C.I. Pigment Yellow 138, C.I. Pigment Yellow 151, C.I. Pigment Yellow 155, C.I. Pigment Yellow 180, and C.I. Pigment Yellow 185. Further, as a red or a magenta pigment, the following may be considered: C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222. Further, as a green or a cyan pigment, the following may be considered: C.I. Pigment Blue 15, C.I. Pigment Blue 15:2, C.I. Pigment Blue 15:3, C.I. Pigment Blue 16, C.I. Pigment Blue 60, C.I. Pigment Green 7. Further, as a black pigment, C. I. Pigment Black 1, C.I. Pigment Black 6, and C.I. Pigment Black 7 may be considered. The contents of the pigments in the corresponding recording liquids are usually within a range from 0.1 to 40% by mass. It is preferable that the contents be within a range from 1 to 30% by mass, and it is more preferable that the contents be within a range from 2 to 20% by mass.

In order to decompose the water in the recording liquids by the electrolysis, an electrolyte component may be added, so as to increase ionic conductivity. As the electrolyte component to be added to the recording liquids, the following can be considered: an inorganic alkali metal salt, such as sodium chloride, potassium chloride, lithium chloride, rubidium chloride, sodium bromide, sodium iodide, sodium sulfate, sodium sulfite, sodium hydrogen sulfite, sodium thiosulfate, potassium sulfate, sodium nitrate, sodium nitrite, potassium nitrate, sodium phosphate, sodium carbonate, and sodium bicarbonate; an organic alkali metal salt, such as sodium acetate, potassium acetate, sodium oxalate, sodium citrate, sodium acid citrate, potassium citrate, and potassium acid citrate; and an organic ammonium salt, such as ammonium chloride, ammonium nitrate, ammonium sulfate, tetramethylammonium chloride, tetramethylammonium nitrate, and choline chloride.

A multivalent metal salt having a valence higher than two may harm solubility or dispersibility of, for example, the colorants or an ABA-type amphiphilic polymer. Thus, a metal salt having a valence of one is preferable. Especially, it is preferable to add a quaternary ammonium salt as the electrolyte component. That is because, since charges are dispersed by alkyl groups bonded to the central elements in the quaternary ammonium ions, the interactions between the quaternary ammonium ions and the colorants and the interactions between the quaternary ammonium ions and the ABA-type amphiphilic polymers are small, and the quaternary ammonium ions stably stay in the recording liquids. Further, since the quaternary ammonium salts tend not to form clusters with the water, it is less likely that the quaternary ammonium salts cause deprival of hydrated water that is necessary for dissolving or dispersing the colorants or the ABA-type amphiphilic polymers. A chemical compound having a lower molecular weight has higher electric conductivity per molecular weight (molar ion conductivity). Among the quaternary ammonium salts, tetramethylammonium salt is particularly preferable. Further, as a counter ion, the chloride ion, the nitrate ion, and the sulfate ion can be considered. However, the chloride ions may cause an electrode reaction at an anode and generate chlorine. Therefore, the nitrate ion or the sulfate ion is preferable, since the nitrate ion and the sulfate ion are relatively inactive.

It is preferable that the anionic dispersing agent includes a polymeric anionic dispersing agent, such as a polymeric dispersant, or a low molecular weight anionic dispersing agent, such as a surfactant. Examples of polymeric dispersants having an anionic group include polyacrylic acid and its salt; polymethacrylic acid, and its salt; a copolymer of acrylic acid and acrylonitrile, and its salt; a copolymer of acrylic acid and acrylic acid alkyl ester, and its salt; a copolymer of styrene and acrylic acid, and its salt; a copolymer of styrene and methacrylic acid, and its salt; a copolymer of styrene, acrylic acid, and acrylic acid alkyl ester, and its salt; a copolymer of styrene, methacrylic acid, and acrylic acid alkyl ester, and its salt; a copolymer of styrene, alpha-methyl styrene, and acrylic acid, and its salt; a copolymer of styrene, alpha-methyl styrene, acrylic acid, and acrylic acid alkyl ester, and its salt; a copolymer of styrene and maleic acid, and its salt; a copolymer of vinylnaphthalene and maleic acid, and its salt; a copolymer of vinyl acetate and ethylene, and its salt; a copolymer of vinyl acetate and crotonic acid, and its salt; a copolymer of vinyl acetate and acrylic acid, and its salt; and a condensation product of beta-naphthalenesulfonic acid-formaldehyde.

These anionic polymers react with hydrogen generated during the electrolysis of water and are condensed. Therefore, it is preferable to add such an anionic polymer to self-dispersing pigments rather than using the self-dispersing pigments only, from the viewpoint of cohesiveness. Further, since these anionic polymers have a function to cause the colorants to adhere, addition of such an anionic polymer improves a transfer ratio of transferring an image from the intermediate transfer body 37 onto the transfer paper S, during a transfer process.

Specific examples of the low molecular weight anionic dispersing agents having anionic groups include dispersing agents including the following component(s): oleic acid and its salt, lauric acid and its salt, behenic acid and its salt, stearic acid and its salt, or such fatty acid and its salt, dodecyl sulfonic acid and its salt, decyl sulfonic acid and its salt, or such as alkyl sulfonic acid and its salt, a kind of alkyl sulfate ester, such as laurylsulfate, or oleyl sulfate, dodecylbenzenesulfonic acid and its salt, lauryl benzene sulfonic acid and its salt, or such as alkyl benzene sulfonic acid and its salt, dioctyl sulfosuccinic acid and its salt, dihexyl sulfosuccinic acid and its salt, or such as dialkyl sulfosuccinic acid and its salt, naphthyl sulfonic acid and its salt, naphthyl carboxylic acid and its salt, or such as an aromatic anionic surfactant, polyoxyethylene alkyl ether acetate, polyoxyethylene alkyl ether phosphoric acid salt, polyoxyethylene alkyl ether sulfonic acid salt, a fluorinated anionic surfactant, such as fluorinated alkyl carboxylic acid and its salt, or fluorinated alkyl sulfonic acid and its salt.

For the recording liquid, water is utilized as the major liquid medium. However, in order to adjust the physical properties of the recording liquids, so that the recording liquids have desired properties, or in order to prevent clogging of the nozzles 61C caused by dried recording liquids, it is preferable to use the water-soluble organic solvents described later as moisturizing agents.

Specific examples of the water-soluble organic solvents include the following: a polyol, such as ethylene glycol, diethylene glycol, triethylene glycol, tetraethylene glycol, propylene glycol, 1,3-propanediol, 2-methyl-1,3-propanediol, 1,4-butanediol, 1,5-pentanediol, 1,6-hexanediol, glycerin, 1,2,6-hexanetriol, 2-ethyl-1,3 hexanediol, 1,2,4-butanetriol, 1,2,3-butanetriol, and 3-methylpentane-1,3,5-triol; a polyhydric alcohol alkyl ether, such as ethylene glycol monoethyl ether, ethylene glycol monobutyl ether, diethylene glycol monomethyl ether, diethylene glycol monoethyl ether, diethylene glycol monobutyl ether, triethylene glycol monobutyl ether, tetraethylene glycol monomethyl ether, and propylene glycol mono-ethyl ether; a polyhydric alcohol aryl ether, such as ethylene glycol monophenyl ether, and ethylene glycol monobenzyl ether; a nitrogen-containing heterocyclic compound, such as N-methyl-2-pyrrolidone, N-hydroxyethyl-2-pyrrolidone, 2-pyrrolidone, 1,3-dimethyl imidazolidinone, and epsilon-caprolactam; an amide, such as formamide, N-methylformamide, and N,N-dimethylformamide; an amine, such as monoethanolamine, diethanolamine, triethanolamine, mono-ethylamine, diethylamine, and triethylamine; a sulphur-containing compound, such as dimethyl sulfoxide, sulpholane, and thiodiethanol; and propylene carbonate, ethylene carbonate, and gamma-butyrolactone. Here, two or more types of the water-soluble organic solvents may concurrently be used.

Further, as other moisturizing ingredients, a sugar alcohol, such as sorbitol; a polysaccharide, such as hyaluronic acid; and a polymer, such as polyethylene glycol may be utilized. Additionally, a natural moisturizing factor may be used, such as urea, lactic acid, citrate, and amino acids. These solvents may be separately used with water. Alternatively, some of these solvents may be mixed and used with water. There is no limitation for the content of such a water-soluble organic solvent. However, it is preferable that the content of the water-soluble organic solvent be within a range from 1% by mass to 60% by mass of the total amount of the ink. Further, it is more preferable that the content of the water-soluble organic solvent be within a range from 10% by mass to 40% by mass of the total amount of the ink.

It is preferable that the recording liquids include the ABA-type amphiphilic polymers and carboxylic acid-based surfactants. Here, the ABA-type amphiphilic polymer includes a hydrophobic A-segment and a hydrophilic B-segment. The carboxylic acid-based surfactants cause the ABA-type amphiphilic polymers to dissolve or to disperse into the above described aqueous solvent.

As the hydrophobic A-segment of the ABA-type amphiphilic polymer, namely, as the hydrophobic A-block, any of the following may be adopted. For example, a straight-chain alkyl group having a carbon number greater than or equal to 12, such as dodecyl, tridecyl, tetradecyl, pentadecyl, hexadecyl, heptadecyl, octadecyl, nonadecyl, and eicosyl may be considered. Further, as a branched alkyl group, such as combinations of 2-decyl dodecyl, 2-dodecyl dodecyl, and 2-decyl hexadecyl may be considered. Further, an alkyl group containing an aromatic group, such as phenylalkyl, diphenylalkyl, triphenylalkyl, naphthylalkyl, dinaphtylalkyl, trinaphthylalkyl, and anthracenyl alkyl may be considered. Further, an alkyl group containing a phenyl group that is a blanched alkyl group having a benzene ring as a branching point, such as dialkylphenylalkyl, and trialkylphenylalkyl may be considered. Further, an alkyl group containing a cyclic alkyl group, such as cyclohexyl alkyl, dialkyl-cyclohexyl alkyl, trialkyl-cyclohexyl alkyl, cyclopentyl alkyl, dialkylcyclopentyl alkyl, and trialkyl-cyclopentyl alkyl may be considered. As described above, it is preferable that the hydrophobic A-block contains at least one of the straightchain alkyl group, the branched alkyl group, the cyclic alkyl group, and the phenyl group.

Further, the hydrophobic A-block may be a block polymer formed of a hydrophobic monomer. Examples of the hydrophobic monomer include a styrenic polymer, an alkyl acrylate polymer, an alkyl methacrylate polymer, an alkyl acrylamide polymer, and an alkyl methacrylamide polymer.

As the hydrophilic B-segment of the ABA-type amphiphilic polymer, namely, as the hydrophilic B-block, an arbitrary block may be adopted, provided that the block has an affinity to the aqueous solvent. In order to increase the viscosity of the components of the ink in the aqueous solvent by the physical cross-linking by hydrophobic association, it may be required that the chain length of the hydrophilic B-block is sufficiently greater than the chain length of the hydrophobic A-block. Examples of such ABA-type amphiphilic polymer include a polymer formed of more than or equal to 100 monomer molecules of ethylene oxide that includes straight-chain polyethylene oxide, and a polymer formed of more than or equal to 100 monomer molecules of propylene oxide. The hydrophilic B-block may have a 4-Arms structure or a 6-Arms structure including multi-branched polyethylene oxide, in which the hydrophilic portions are branched off. Here, "Arms" means the hydrophobic A-block. As described above, it is preferable that the hydrophilic B-block includes at least one of straight-chain polyethylene oxide and multi-branched polyethylene oxide.

Further, it is preferable that the ABA-type amphiphilic polymer be an $A_nB$-type amphiphilic polymer that includes 3 or more hydrophobic A-blocks. That is because, when the ABA-type amphiphilic polymer is an $A_nB$-type amphiphilic polymer that includes 3 or more hydrophobic A-blocks, hydrophobic association between the A-segments tends to occur, and a viscosity response with respect to a change in pH is improved. Incidentally, "the ABA-type" in the ABA-type amphiphilic polymer means that the ABA-type amphiphilic polymer has a structure such that the hydrophilic B-block and the plural hydrophobic A-blocks are combined while centered by the hydrophilic B-block.

In addition, as the hydrophilic B-block, a vinyl alcohol polymer, a vinyl ether polymer, a vinylpyrrolidone polymer, an acrylamide polymer, a methacrylamide polymer, and their derivatives may be considered. Further, the hydrophilic B-block may be ionic, and as the hydrophilic B block, an acrylic acid salt polymer, a polymer of methacrylate, a polymer of acrylic acid alkyl quaternary ammonium salt, a polymer of methacrylic acid alkyl quaternary ammonium salt, a polymer of acrylamide alkyl quaternary ammonium salt, and a polymer of styrenesulfonate may be considered. Furthermore, as the hydrophilic B-block, the following may be considered: a cellulose derivative, such as methylcellulose, ethyl cellulose, hydroxyethyl cellulose, and caboxymethyl cellulose; a derivative of starch, such as methyl starch, ethyl starch, hydroxyethyl starch, and carboxymethyl starch; an alginic acid derivative, such as propylene glycol alginate; a derivative of an animal-based polymer, such as gelatin, casein, albumin, and collagen; a derivative of a plant-based polymer, such as guar gum, locust bean gum, quince seed gum, and carrageenan; and a microorganism-based polymer, such as xanthan gum, dextran, hyaluronic acid, pullulan, and curdlan. Any chemical bond between the hydrophobic A-block and the hydrophilic B-block is sufficient, as long as the chemical bond is stable. Examples of the chemical bond include an ether linkage, a urethane bond, an amide bond, and an ester bond.

Any carboxylic acid-based surfactants that cause the ABA-type amphiphilic polymers to dissolve or to disperse into aqueous solvent may be utilized, as long as the carboxylic acid-based surfactant is formed of a hydrophobic alkyl portion and carboxylate. Examples of such carboxylates include fatty acid salts, such as sodium caproate, caproic acid potassium, sodium caprylate, caorylic acid potassium, sodium caprate, potassium caprate, sodium laurate, potassium laurate, sodium myristate, potassium myristate, sodium palmitate, potassium palmitate, sodium stearate, and potassium stearate. Further, in addition to the above described monocarboxylic acid salts, dicarboxylates and tricarboxylic acid salts may be utilized.

As described later, the viscosity of the compositions of the water based inks included in the recording liquids vary depending on the levels of pH of the recording liquids. However, the changes in the levels of pH of the recording liquids according to the embodiment mean that protons are supplied to the compositions of the inks. As an index of the level of pH for the protonation of the carboxylic ions, which are weak acid salts, pKa may be utilized. The range of the values of pKa for the fatty acid salts is from 7 to 9, and a higher pKa value is preferable.

There is no particular limitation for the average molecular weight of the ABA-type amphiphilic polymer. It is preferable that the molecular weight be low, taking into consideration the inkjet discharging performance in a state in which the ABA-type amphiphilic polymers are completely dissolved or dispersed by the carboxylic acid-based surfactants. However, taking into consideration the strength of the state in which the viscosity is increased after the recording liquid is adhered to the transfer paper, it is preferable that the molecular weight of the polymer be high. Therefore, it is preferable that the molecular weight of the ABA-type amphiphilic polymer be greater than or equal to 10,000, and less than or equal to 100,000. Further, it is more preferable that the molecular weight of the ABA-type amphiphilic polymer be greater than or equal to 20,000, and less than or equal to 50,000. It is preferable that the repeating number of the polymer part be greater than or equal to 100 monomer molecules, and less than or equal to 1000 monomer molecules. It is preferable that the density of the polymers in the composition of the ink be in a range that is greater than or equal to 0.1% by mass and less than or equal to 10% by mass. It is more preferable that the density be in a range that is greater than or equal to 0.5% by mass and less than or equal to 5% by mass.

The viscosity of the recording liquid during discharging of the recording liquid is in a range from 1 mPa·s to 20 mPa·s. It is preferable that the viscosity be in a range from 2 mPa·s to 8 mPa·s. After the recording liquid is adhered to the transfer paper, due to a change in the level of pH (described later), the viscosity of the recording liquid is increased at least 10 times, preferably 100 times, more preferably at least 1000 times, as much as the viscosity of the recording liquid during the discharging. In addition to the above described physical properties of the recording liquid, it is preferable that the surface tension of the recording liquid be within a range from 10 mN/m to 60 mN/m, preferably within a range from 20 mN/m to 50 mN/m, and that the electric conductivity of the recording liquid be within a range from 0.01 S/m to 3 S/m, preferably within a range from 0.02 S/m to 1 S/m.

As shown in FIGS. 2A-2C, each of the heads 61Y, 61M, 61C, and 61BK includes a nozzle plate 61*a*, a nozzle 61*b*, an ink chamber 61*c*, and an ink discharging unit (not shown). In FIGS. 2A-2C, the nozzle plate 61*a* is placed at a side, from which the recording liquid is discharged, and faces downward. The nozzle 61*b* is formed in the nozzle plate 61*a*. The recording liquid is supplied from the corresponding distributor tank to the ink chamber 61*c*. The ink chamber 61*c* is filled with the recording liquid. The ink discharging unit causes the recording liquid in the ink chamber 61*c* to discharge from the nozzle 61*b*. Plural sets of the nozzle plate 61*a*, the nozzle 61*b*, the ink chamber 61*c* and the ink discharging unit are included in the heads 61Y, 61M, 61C, and 61BK. However, in FIGS. 2A-2C, only one set of the nozzle plate 61*a*, the nozzle 61*b*, the ink chamber 61*c* and the ink discharging unit is shown. The heads 61Y, 61M, 61C, and 61BK include the corresponding nozzle plates 61*a*. However, in each of the heads 61Y, 61M, 61C, and 61BK, the corresponding nozzle plate 61*a* is common for the all nozzles 61*b* included in the head.

The nozzle plate 61*a* includes an electrically-conductive substrate and a water-repellent film formed on the substrate at the side facing the intermediate transfer body 37 (the details are not shown in FIGS. 2A-2C). The water-repellent film is not particularly limited, as long as it has water repellency. For example, the water-repellent film may be formed by applying a fluorine-based water repellent or a silicone-based water repellent to the substrate, or by coating the substrate with a fluorine-based polymer or a fluorine-metal compound eutectoid. The nozzle plate 61*a* includes a surface at the side of the ink chamber 61*c*, which is an interface forming part that forms an interface between the nozzle plate 61*a* and the recording liquid inside the ink chamber 61*c*. As described later, the nozzle plate 61*a* functions as a cathode.

The whole nozzle plate 61*a* may be electrically conductive. Alternatively, the nozzle plate 61*a* may be a member such that only the side of the ink chamber 61*c* is processed to be electrically conductive, or the nozzle plate 61*a* may be formed of an electrically-conductive member placed at the side of the ink chamber 61*c* and an insulating member placed at the side of the intermediate transfer body 37.

As described later, since the electrically-conductive part of the nozzle plate 61*a* functions as the cathode, it may not be required that the electrically-conductive part is formed of a material having resistance to metal elution. The electrically-conductive part of the nozzle plate 61*a* may be formed of a material having a high electric conductivity, such as a metal or a carbon.

The nozzle plate 61*a* is arranged, so that a distance between the nozzle plate 61*a* and the intermediate transfer body 37 is from 50 μm to 200 μm. When the distance between the nozzle plate 61*a* and the intermediate transfer body 37 is less than 50 μm, it may be difficult to maintain the distance between the intermediate transfer body 37 and the nozzle plate 61*a*. On the other hand, when the distance between the nozzle plate 61*a* and the intermediate transfer body 37 is greater than 200 μm, the bridge of the liquid column (described later) may not be formed. Here, the distance between the nozzle plate 61*a* and the intermediate transfer body 37 may be less than 50 μm, provided that the distance can be maintained. Similarly, the distance between the nozzle plate 61*a* and the intermediate transfer body 37 may be greater than or equal to 200 μm, provided that a stable bridge of the liquid column can be formed.

The ink discharging unit includes a piezoelectric element that causes the recording liquid to be discharged through the nozzle 61*b* as liquid droplets and that causes the discharged liquid droplets to adhere to the transfer paper S. The ink discharging unit discharges the recording liquid from the nozzle 61*b* in accordance with a driving signal that is voltage pluses applied from the control unit 40 to the piezoelectric element. In this regard, the control unit 40 functions as an ink discharging control unit. The control unit 40 that functions as the ink discharging control unit generates the driving signal for driving the piezoelectric element and for causing the recording liquid to be discharged through the nozzle 61*b* by using predetermined signal waveforms, namely, predetermined drive waveforms. Then the control unit 40 inputs the generated driving signal to the piezoelectric element.

In this manner, the heads 61Y, 61M, 61C, and 61BK, to be more specific, the nozzles 61*b* included in the corresponding heads 61Y, 61M, 61C, and 61BK discharge the corresponding recording liquids in accordance with the driving signals generated by the control unit 40 that functions as the ink discharging control unit.

The actuator included in the ink discharging unit may be another type of moveable actuator, in which the element changes its shape, as it is in the piezoelectric method. Alternatively, the ink discharging unit may discharge the recording liquid through the nozzle 61*b* based on a heating method, such as a thermal method.

The voltage apply unit 33 includes a power source 33*a*, an electric circuit (not shown), a current sensor 35, and a voltage application control unit. The electric circuit connects the power source 33*a* to the support body 37*a* and connects the power source 33*a* to the nozzle plate 61*a*. The current sensor 35 is connected to the electric circuit, and measures the electric current that flows across the recording liquid, when the recording liquid temporarily bridges between the corresponding one of heads 61Y, 61M, 61C, and 61BK and the intermediate transfer body 37. The voltage application control unit is realized as apart of the functions of the control unit 40. The voltage application control unit controls timings for applying the voltages from the power source 33*a*, and a time interval for which the voltage is applied. The control unit 40 as the voltage application control unit also functions as a voltage changing unit that changes the voltage from the power source 33*a*.

An anode of the power source 33*a* is connected to the support body 37*a* and a cathode of the power source 33*a* is connected to the nozzle plate 61*a*. Accordingly, the voltage applying unit 33 includes the intermediate transfer body 37 as the anode, and the nozzle plate 61*a* as the cathode.

In the embodiment, the current sensor 35 measures the electric current during idle discharging, prior to forming an image, as described later. However, the current sensor 35 may measure the electric current while the recording liquid is being discharged, so as to form an image. The current sensor 35 inputs the measured electric current to the control unit 40.

The temperature sensors 62 are temperature measuring devices that measure temperatures of the corresponding heads 61Y, 61M, 61C, and 61BK, to be more specific, temperatures inside the corresponding heads 61Y, 61M, 61C, and 61BK, so as to detect changes of the physical properties of the corresponding recording liquids associated with temperature changes in usage environments of the corresponding recording liquids. Here, the temperature sensors 62 substantially measure the temperatures of the corresponding recording liquids. Alternatively, the temperature sensor 62 may directly measure the temperatures of the corresponding recording liquids. Additionally, the temperature sensors 62 may be arranged at the vicinities of the corresponding heads 61Y, 61M, 61C, and 61BK, within which the temperature sensors 62 can substantially measure the temperatures of the corresponding recording liquids, so as to measure the temperatures of the corresponding heads 61Y, 61M, 61C, and 61BK, provided that the temperature sensors 62 can detect changes of the physical properties of the corresponding recording liquids associated with the temperature changes in the usage environments of the corresponding recording liquids. The temperature sensors 62 input the measured temperatures to the control unit 40.

As shown in FIG. 1, the cleaning unit 34 includes a cleaning member and a cleaning blade. Here, the cleaning member is formed of a rubber, as an elastic body, that contacts the intermediate transfer body 37 while the cleaning member is slanted against the direction of the rotation of the intermediate transfer body 37. The cleaning unit 34 may include a cleaning roller, as the cleaning member, in addition to the cleaning blade.

In the image forming device 100 having the above described configuration, when a predetermined signal for starting image formation is input, the intermediate transfer body 37 rotates in the A1 direction while facing the heads 61Y, 61M, 61C, and 61BK. In this process, the head 61Y, 61M, 61C, and 61BK discharge the corresponding recording liquids in yellow, magenta, cyan, and black, at different timings from the upstream side to the downstream side in the A1 direction, so that the yellow recording liquid, the magenta recording liquid, the cyan recording liquid, and the black recording liquid are sequentially superposed, and so that the yellow image area, the magenta image area, the cyan image area, and the black image area are superposed at the same position on the intermediate transfer body 37. The formed images are temporarily supported on the intermediate transfer body 37.

At the same time, the control unit 40 that functions as the voltage apply control unit drives the voltage application unit 33, and the voltage application unit 33 applies a voltage between the support body 37*a* and the nozzle plate 61*a*. In this state, the heads 61Y, 61M, 61C, and 61BK apply the corresponding recording liquids onto the intermediate transfer body 37. During the application of the recording liquids, as shown in FIG. 2A, the recording liquids forming meniscuses at the corresponding nozzles 61*b* move from the corresponding heads 61Y, 61M, 61C, and 61BK toward the intermediate transfer body 37. In this manner, bridges of liquid columns formed of the corresponding recording liquids are temporarily formed between the corresponding nozzles 61*b* and the intermediate transfer body 37, as shown in FIG. 2B. Subsequently, as shown in FIG. 2C, the bridges of the liquid columns formed of the corresponding recording liquids are divided and the corresponding recording liquids are supported by the intermediate transfer body 37. In this manner, the image is formed by the recording liquids on the intermediate transfer body 37.

Further, in the state in which the bridge of the liquid column formed of the corresponding recording liquid is formed, as shown in FIG. 2B, the components of the colorant in the recording liquid receive a cohesion effect from the voltage application unit 33. Specifically, when the voltage is applied by the voltage application unit 33, the electrode reaction (1) described below occurs at the nozzle plate 61*a*, which is the cathode. Further, the electrode reaction (2) described below occurs at the intermediate transfer body 37, which is the anode. In this manner, the water included in the bridge of the liquid column formed of the corresponding recording liquid is decomposed by the electrolysis.

$$\text{Cathode: } 4H_2O+4e^- \rightarrow 2H_2+4OH^- \qquad \text{reaction formula (1)}$$

$$\text{Anode: } 2H_2O \rightarrow 4H^+ + O_2 + 4e^- \qquad \text{reaction formula (2)}$$

Figure 3:
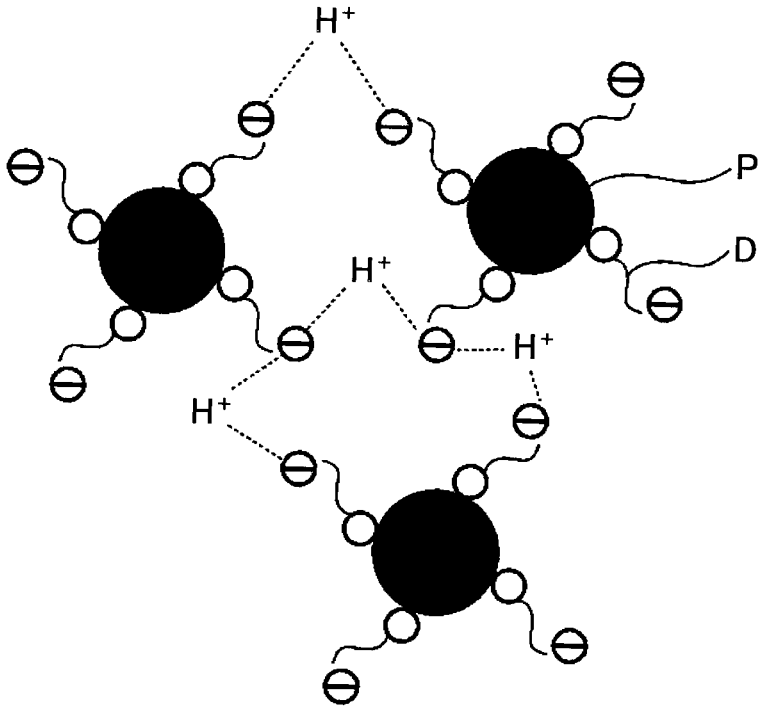
FIG. 3 is a schematic diagram showing a state such that pigments included in the electrically-conductive recording liquid discharged from the head condense through protons, in the image forming device shown in FIG. 1.

With this, on the surface of the intermediate transfer body 37, which functions as the anode, the water included in the bridge of the liquid column formed of the corresponding recording liquid is oxidized and protons ($H^+$) are generated. Thus, as shown in FIG. 3, the pigments P dispersed in the anionic dispersant D are condensed through the protons. Alternatively, when the recording liquid includes the ABA-type amphiphilic polymers and the carboxylic acid-based surfactants, the hydrophobic groups of the ABA-type amphiphilic polymers are combined with each other by the protonization of the carboxylic acid-based surfactants, and the viscosity of the recording liquids increases. In this manner, the blurring between the neighboring dots is prevented from occurring, and high-resolution images are formed. Further, such an application of the voltage has an advantage such that it prevents clogging of the nozzles 61*b*. Incidentally, the time interval during which the bridge of the liquid column is formed may be controlled by, for example, a peak voltage of the electromagnetic pulse applied to the piezoelectric element and a width of the pulse.

Figure 4:
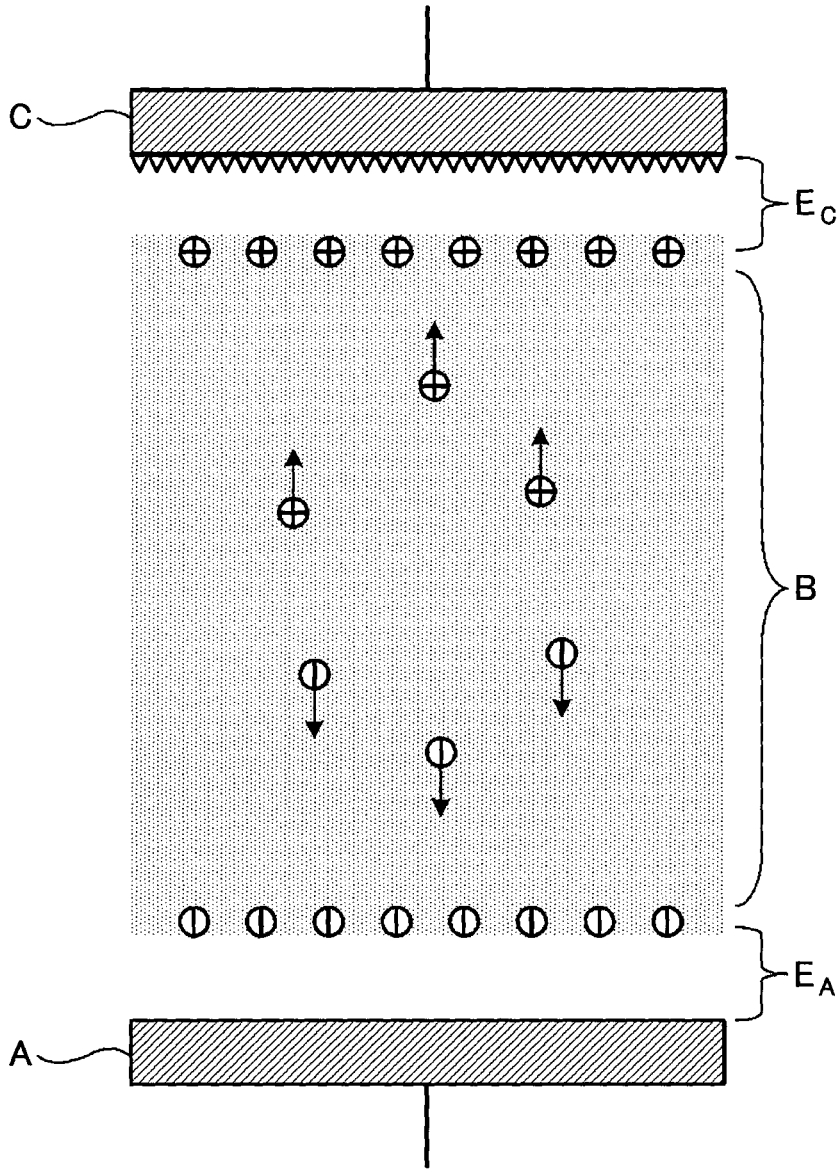
FIG. 4 is a conceptual diagram showing a state of a liquid column formed of the electrically-conductive recording liquid between a cathode and an anode, in the image forming device shown in FIG. 1.

Here, the bridge of the liquid column formed between the cathode and the anode is explained using FIG. 4. In the bridge B of the liquid column, cations move toward the vicinity of the cathode C, and anions move toward the vicinity of the anode A. Consequently, an electric double layer $E_C$ is formed on a surface of the cathode C, and an electric double layer $E_A$ is formed on a surface of the anode A. Charging rates of the electric double layers $E_C$ and $E_A$ are determined by the electric conductivity of the bridge B of the liquid column and the density of ions included in the recording liquid. At this time, when the voltage of the electric double layer $E_A$ reaches several volts, the water is decomposed by the electrolysis and a faradaic current flows. As a consequence, on the surface of the anode A, the water is oxidized and protons are generated, and the pigments dispersed by the anionic dispersant are condensed out or the viscosity of the recording liquid is increased. Namely, at the moment in which the bridge is formed, the ions that cause the pigments to be condensed out are efficiently generated in the bridge. Thus the recording liquid is adhered to the intermediate transfer body 37, and at the same time the pigments are condensed out. Consequently, the burring does not occur between the neighboring dots formed of the recording liquid, and very high-resolution solute images are formed.

As described above, the voltage application unit 33 has a configuration to apply the voltage between the intermediate transfer body 37 and the heads 61Y, 61M, 61C, and 61BK (specifically, the corresponding nozzle plates 61*a*), so as the decompose the corresponding recording liquid forming the bridge B of the liquid column by the electrolysis. The voltage application control unit, which is the control unit 40 that functions as the voltage changing unit, controls the application of the voltage, so as to suppress electric discharges due to the voltage applied to the recording liquid. Such an electric discharge and a mode of control are explained later in detail.

Usually, the time interval between the formation of the bridge B of the liquid column and the division of the bridge B is in a range from several microseconds to several tens of microseconds. The electric conductivity of the recording liquid is usually within a range from several tens of mS/m to several hundreds mS/m. Therefore, in order to form an image on the intermediate transfer body 37 by the recording liquid, the application voltage of, for example, 1.23 volts, which is the theoretical decomposition voltage of water, or a voltage in a range from several volts to several tens of volts, which is a usual voltage for decomposing water, from the voltage application unit 33 may not be sufficient. It is preferable that the voltage from the voltage application unit 33 be within a range from several tens of volts to several hundreds of volts.

A single transfer paper S fed from the paper feed unit 20 is fed to the transfer unit 31, in synchronization with the timing in which a front tip of an image supported on the intermediate transfer body 37 reaches the transfer unit 31. The image supported on the intermediate transfer body 37 is transferred onto the transfer paper S that passes through the transfer unit 31, while the transfer roller 38 is being driven. In this manner, an image is formed on the surface of the transfer paper S. The transfer paper S, on which the image has been formed, is guided to the paper discharge table 25 and is stacked onto the paper discharge table 25.

As described above, when the image is transferred onto the transfer paper S, the recording liquid, which is condensed and whose viscosity is increased, is transferred onto the transfer paper S. Therefore, even if the transfer paper S is a plain paper, by forming images with the recording liquids, which are condensed and whose viscosities are increased by the above described condensing effect and thickening effect, the high density and high quality images can be formed at a high speed, while preventing or suppressing feathering and bleeding.

Further, when the image formation is performed at a high speed, the recording liquids may be required to have quick drying properties, and, in general, the recording liquids are highly absorbed by the transfer paper S. However, in such a case, the recording liquids penetrate deep into the transfer paper S, and bleed-throughs occur. In this case, the recording liquids are not suitable for double-sided image formation. However, by the condensing effect and the thickening effect, the amounts of the recording liquids absorbed by the transfer paper S are reduced, and the bleed-throughs are prevented or suppressed. Thus the recording liquids are also suitable for the double-sided image formation. Furthermore, since the amounts of the recording liquids absorbed by the transfer paper S are reduced, the deformation of the transfer paper S, such as a curl, is prevented or suppressed. At the same time, it becomes easy to convey the transfer paper S, on which the image has been transferred, and a paper jam is prevented or suppressed. Therefore, it becomes easy to handle the transfer paper S.

On the intermediate transfer body 31, from which the image has been transferred onto the transfer paper S at the transfer unit 31 and which has passed through the transfer unit 31, almost no components originated from the recording liquids are remaining. Since the intermediate transfer body 37 is cleaned by the cleaning unit 34, the residual amounts of the recording liquids are reduced. Thus, even if the image formation is repeatedly performed, the surface of the intermediate transfer body 37 is prevented from being degraded. Therefore, degradation of images and the intermediate transfer body 37 is suppressed or prevented, and fine images may be formed for a long time.

In the above described image forming device 100, in order to perform the fine image formation, in which the blurring is suppressed or prevented by the above described condensing effect and thickening effect, sufficient amounts of protons per unit volumes of the recording liquids for performing such fine image formation may be ensured. Here, the protons are generated on the surface of the intermediate transfer body 37 by the reaction formula (2). Such amounts of the protons increase, when the electrolysis represented by the reaction formula (2) is facilitated.

Here, a generation rate of the protons is determined by an integrated value of electric currents I that flow across the recording liquids in the corresponding states per unit time, in which the recording liquids temporarily bridge between the corresponding heads 61Y, 61M, 61C, and 61BK and the intermediate transfer body 37. The electric currents I are determined by (a) and (b) below.

(a) Voltages are applied from the voltage apply unit 33 to the corresponding recording liquids during time intervals in which the recording liquids bridge between the intermediate transfer body 37 and the corresponding heads 61Y, 61M, 61C, and 61BK, specifically between the intermediate transfer body 37 and the corresponding nozzle plates 61*a*. Here, the electric currents I are proportional to the voltages during the time intervals.

(b) Electric resistances of the recording liquids

The electric currents I are inversely proportional to the electric resistances of the corresponding recording liquids during the time intervals. The values R of the electric resistances are determined by electric conductivities o of the corresponding recording liquids and the shapes of the liquid columns formed of the corresponding recording liquids. The values Rare represented by the formula (A) below. In the formula (A), r(x) indicates a radius of a liquid column at a position x, when the discharging direction of each of the recording liquids is set to the x-axis, as shown in FIG. 5.

[Expression 1]

$$R = \int \frac{1}{\sigma(\pi \cdot r(x)^2)} dx \tag{A}$$

As described above, regarding (a), there is a problem that, when the voltages are increased, required power increases and the recording liquids are scattered by occurrences of electric discharges. Regarding the electric conductivities of the recording liquids described in (b), it is possible that the dispersing stability of the pigments is lowered by large amounts of the electrolytes.

Therefore, in order to ensure that sufficient amounts of the protons are generated while avoiding the above described problems, it is preferable that the shapes of the liquid columns formed of the corresponding recording liquids are devised. It is found by observing the shapes of the liquid columns of the corresponding recording liquids that, in general, the recording liquid discharged from the nozzle has a shape such that a tip is thick and the remaining portion has a pillar shape. As the time is elapsed, the recording liquid in the vicinity of the nozzle becomes gradually smaller in diameter, and is disconnected, eventually. Therefore, when the voltage is kept constant, the current that flows across the recording liquid forming the liquid column is the greatest at the moment at which the recording liquid contacts the surface of the intermediate transfer body 37, and the current is reduced as the diameter of the liquid column becomes smaller, as the time is elapsed.

Thus, in the image forming device 100, the control unit 40 that functions as the ink discharging control unit generates driving signals that cause the positions of the meniscuses to be placed outside of the corresponding nozzles 61*b*, in other words, the driving signals that cause the positions of the meniscuses to be placed outside of the corresponding nozzle plates 61*a* or the corresponding heads 61Y, 61M, 61C, and 61BK, as the driving signals that cause the corresponding recording liquids to be discharged from the corresponding nozzles 61*b*, during a time interval in which the recording liquids temporarily bridge between the corresponding heads 61Y, 61M, 61C, and 61BK and the intermediate transfer body 37.

Figure 5A:
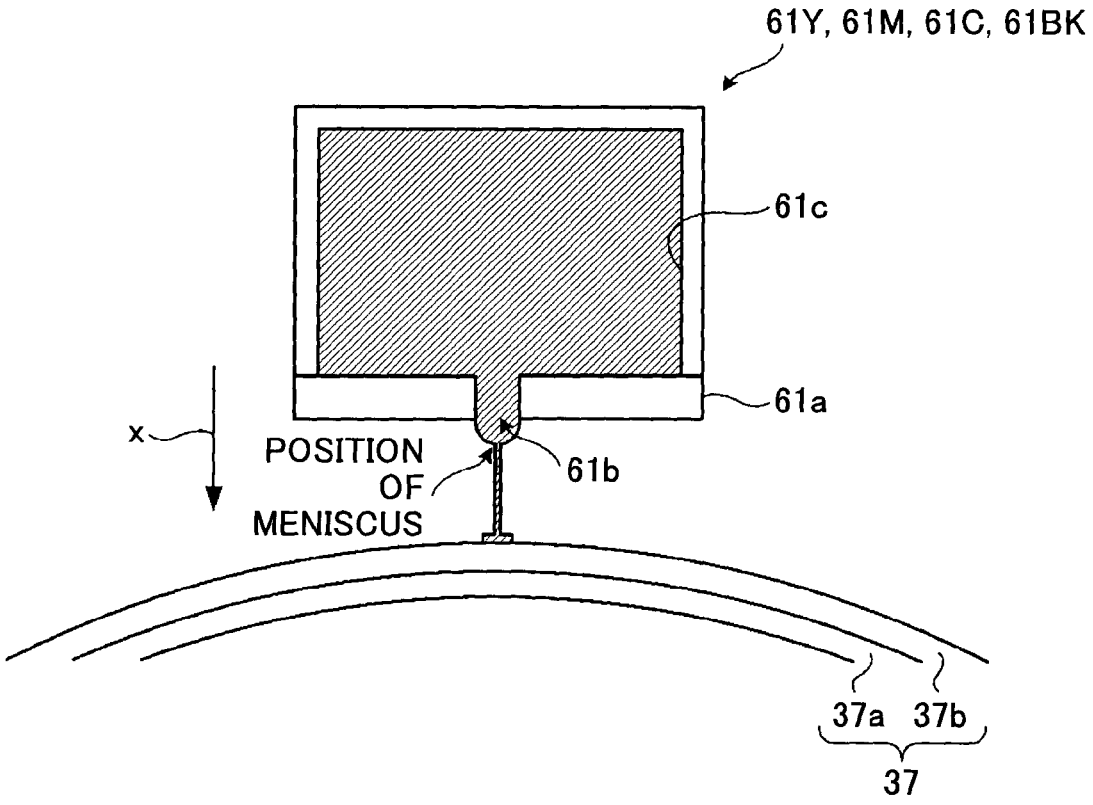
FIGS. 5A and 5B are conceptual diagrams illustrating that a driving signal is formed by a discharging control unit, so that a position of a meniscus is placed at an outer side of a nozzle, during a time period in which the recording liquid temporarily bridges between the head and the intermediate transfer belt.
Figure 5B:
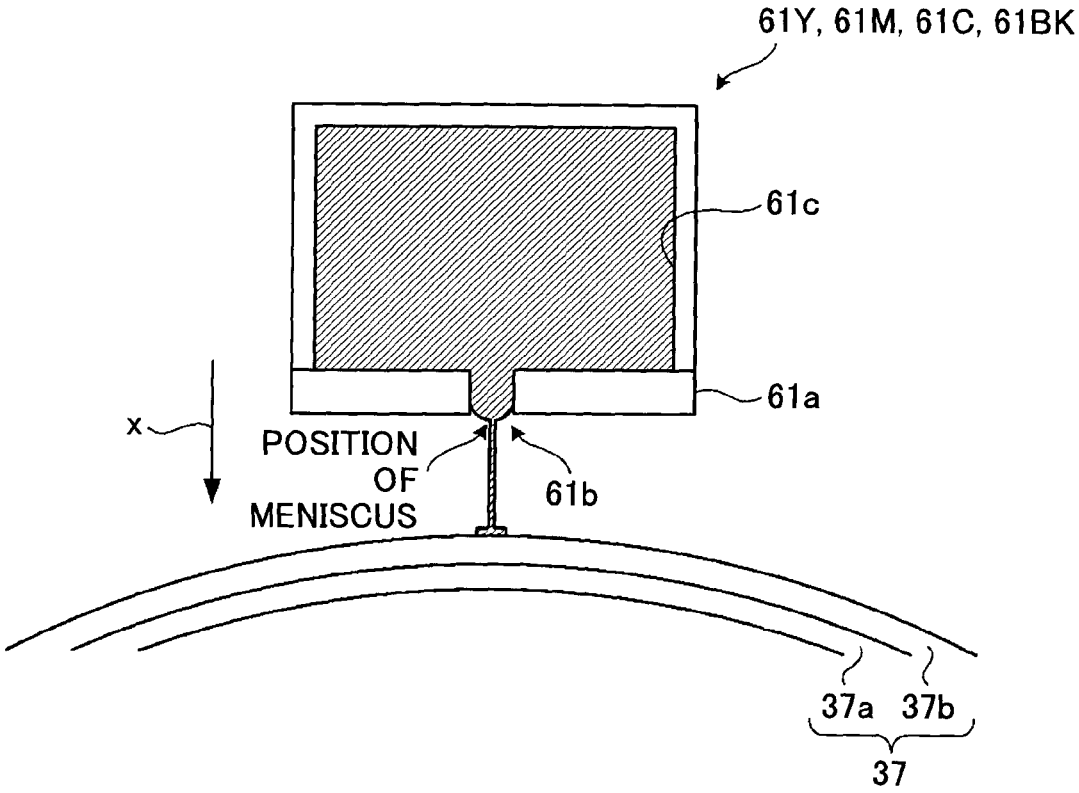

Here, the position of the meniscus is a position of the center portion of the meniscus that is formed of the corresponding recording liquid to have a hemispherical shape at the corresponding nozzle 61*b*, when the corresponding recording liquid except for the liquid column having a pillar shape is considered in FIGS. 5A and 5B. In other words, the position of the meniscus is a position that might be a tip portion in the x-axis direction of the recording liquid forming the meniscus. The position of the meniscus is the position in the vicinity of a boundary between the hemispherical portion of the meniscus and the pillar shaped portion of the liquid column in the x-axis direction, as shown in FIGS. 5A and 5B. Therefore, the state in which the corresponding recording liquid bridges and the position of the meniscus is placed outside of the nozzle 61*b* indicates a state in which the corresponding recording liquid protrudes from the whole of the nozzle 61*b*.

Here, it is not necessary that the position of the meniscus is placed outside the corresponding nozzle 61*b*, during the whole time interval in which the bridge of the liquid column is being formed. The position of the meniscus may be placed outside the corresponding nozzle 61*b* during a part of the time interval.

When the position of the meniscus is arranged in such a way, the electric resistance of the liquid column formed of the corresponding recording liquid, as shown in FIG. 2B and in FIGS. 5A and 5B, is relatively reduced during a certain time interval, and the decomposed amounts per unit volume of the corresponding recording liquid is increased. Therefore, the amount of the protons per unit volume of the corresponding recording liquid is increased. Here, for the recording liquid shown in FIG. 5, the liquid column formed of the recording liquid, whose electric resistance is reduced during the certain time interval, includes the recording liquid that forms the portion of the meniscus.

Incidentally, when the amount of such protons is sufficient, the voltage to be applied may be reduced by the voltage apply unit 33, without using the driving signal that causes the position of the meniscus to be outside the nozzle 61*b* while forming the bridge. When the voltage is reduced, the power that may be required for applying the voltage with the voltage apply unit 33 is reduced, and at the same time, scattering of the recording liquid due to electric discharges in the recording liquid is reduced. Thus, finer images may be formed. Further, in such a case, the amounts of the electrolytes included in the recording liquid may be reduced, additionally or alternatively to reducing the voltage to be applied by the voltage apply unit 33. When the amounts of the electrolytes included in the recording liquid are reduced, the cost and the materials of the recording liquid may be reduced.

FIGS. 6A through 6D show specific examples of the driving signals that realize the shape of the liquid column, in which the position of the meniscus is outside the nozzle 61*b*, during the formation of the bridge. As shown FIGS. 6A through 6D, the driving signal includes a first driving signal as a first driving pulse and a second driving signal as a second driving pulse. Here, the driving signal is generated by the control unit 40 that functions as the ink discharging control unit. The first driving signal is formed of a first signal waveform. The second driving signal is formed of a second signal waveform. The first driving signal and the second driving signal are separated by a predetermined time interval.

Figure 6A:
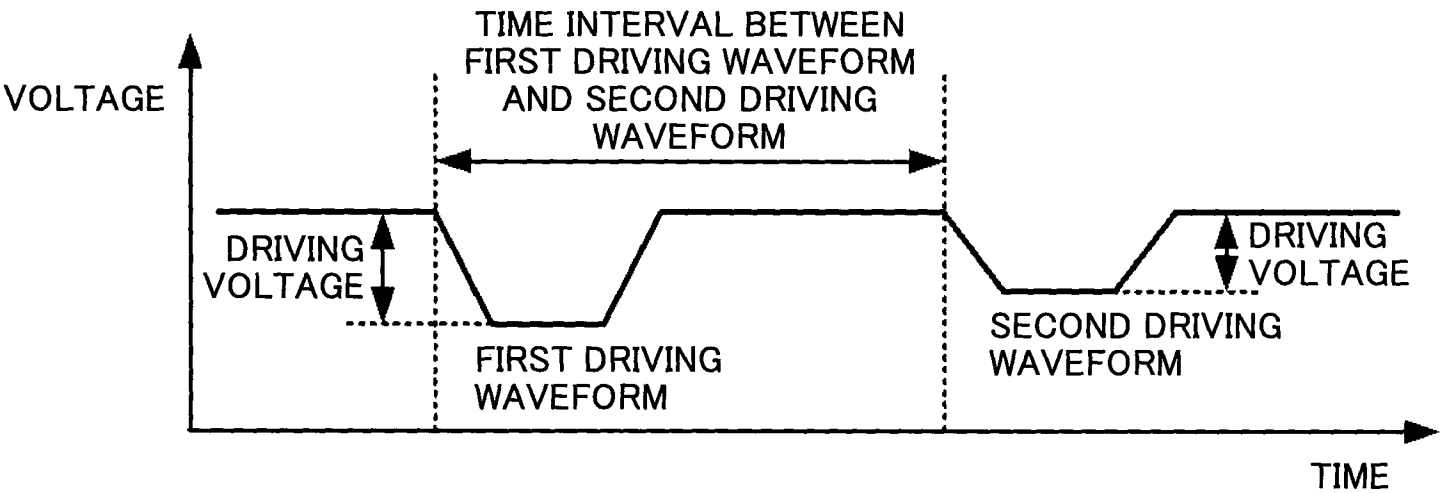
FIGS. 6A through 6D are conceptual diagrams illustrating examples of a first signal and a second signal generated by the discharging control unit.
Figure 6B:
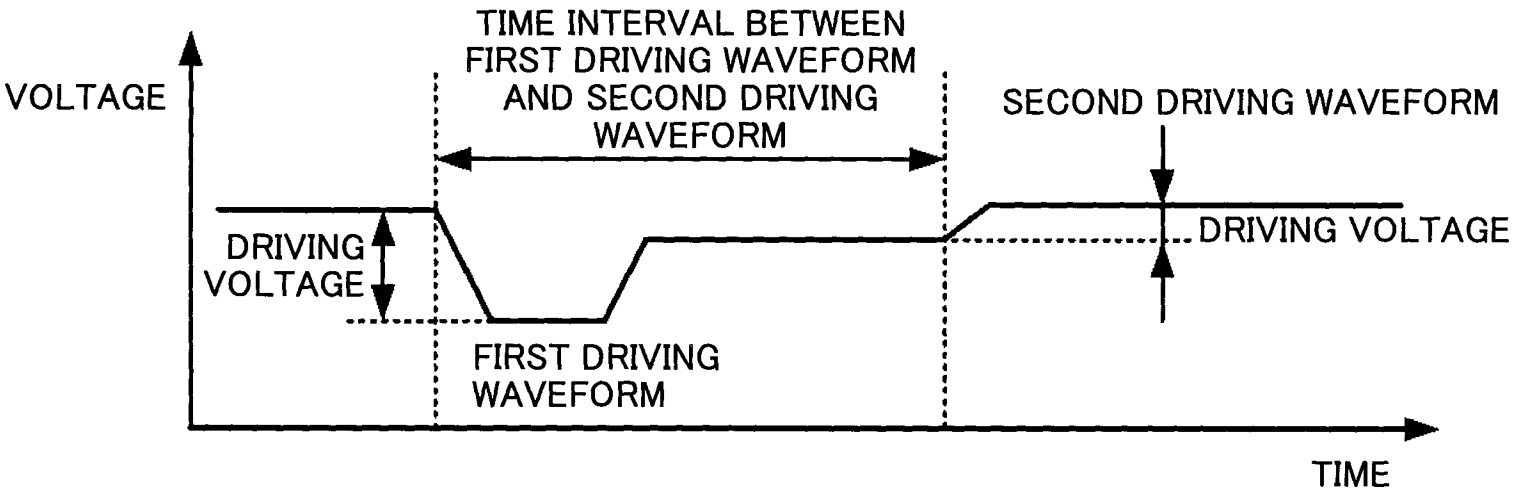
Figure 6C:
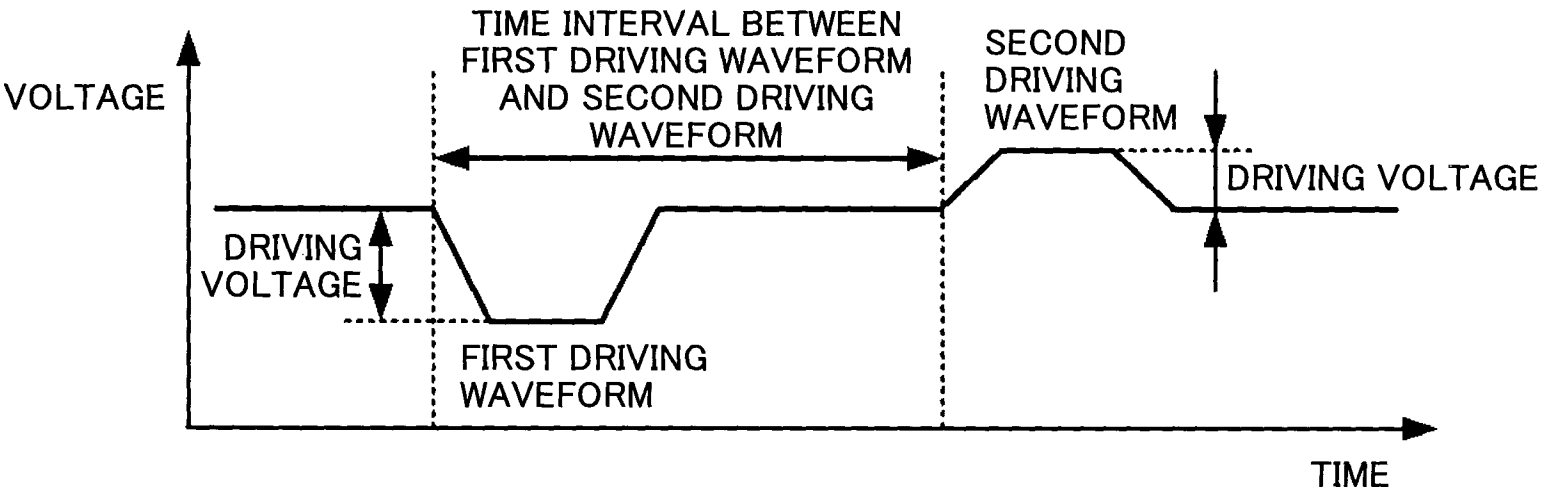
Figure 6D:
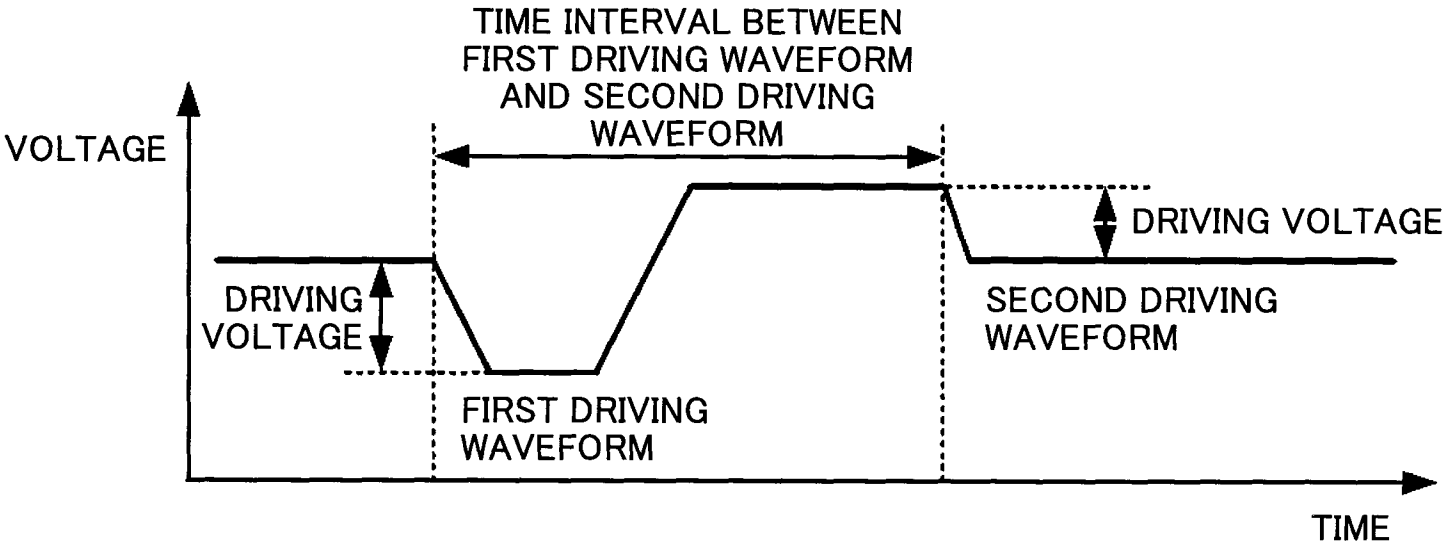

In FIG. 6A, the first driving signal and the second driving signal are generated. Here, the first driving signal is for causing the corresponding recording liquids discharged from the nozzles 61*b* to form the bridges between the heads 61Y, 61M, 61C, and 61BK and the intermediate transfer body 37, specifically, the corresponding nozzle plates 61*a* and the intermediate transfer body 37. The second driving signal is for additionally discharging the corresponding recording liquids from the corresponding nozzles 61*b*, in the states formed by the first driving signal.

In the example shown in FIG. 6A, the second driving signal mitigates the reduction of the diameter of the liquid column by supplying the recording liquid to the portion in the vicinity of the nozzle 61*b*, where the liquid column is thinning, and mitigates the reduction of the current flowing across the liquid column formed of the recording liquid by the voltage applied from the voltage apply unit 33. In other words, the second driving signal is generated, so as to maintain the electrolysis represented by the reaction formula (2), and is input to the piezoelectric element.

In the example shown in FIG. 6A, the time interval between a first driving waveform and a second driving waveform, namely, the time interval between the time at which the first driving signal is input and the time at which the second driving signal is input is set, so that the electrolysis is efficiently maintained by additional discharging of the recording liquid, namely, so that the shape of the liquid column formed of the recording liquid is maintained to be the shape with which the efficiency of the electrolysis is maintained.

Here, if the recording liquid discharged from the nozzle 61*b* by the second driving signal is adhered to the intermediate transfer body 37, the volume of the recording liquid supported by the intermediate transfer body 37 and that forms an image is increased. Namely, the volume of the recording liquid to be condensed and to be thickened by the electrolysis is increased. Consequently, the power corresponding to the condensed amount and the thickened amount may be required. Therefore, the amount of the protons per unit volume of the recording liquid is not expected to be greatly increased.

Therefore, in the example shown in FIG. 6A, the control unit 40 that functions as the ink discharging control unit generates the second driving signal, so that the amount of the recording liquid additionally discharged from the nozzle 61*b* returns to the nozzle 61*b*. In other words, the control unit 40 generates the second driving signal, so that the amount of the recording liquid additionally discharged from the nozzle 61*b* is not adhered to the intermediate transfer body 37.

Here, it is not required that the second driving signal in the example shown in FIG. 6A is formed, so that the whole amount of the recording liquid additionally discharged from the nozzle 61*b* strictly returns to the nozzle 61*b*. It suffices that the second driving signal is generated, so as to ensure that a sufficient amount of the protons is generated per unit volume of the recording liquid.

Here, when the first driving signal and the second driving signal are utilized, the stronger the second driving signal is, the smaller the amount of the recording liquid adhered to the intermediate transfer body 37 becomes, in comparison to the case in which only the first driving signal is utilized, provided that the recording liquid additionally discharged by the second driving waveform is not adhered to the intermediate transfer body 37. This is because, when the additionally discharged recording liquid returns to the nozzle 61*b*, the additionally discharged recording liquid may pull in a portion of the recording liquid that has been discharged by the first driving waveform toward the nozzle 61*b*.

Therefore, the time interval between the time at which the first driving signal is input and the time at which the second driving signal is input is set, so that the time interval corresponds to the oscillation period of the meniscus at the nozzle 61*b*, in addition to the above described viewpoint that the shape of the liquid column formed of the recording liquid is maintained to be the shape with which the efficiency of the electrolysis is maintained.

In this regard, when a phase of a residual oscillation of the meniscus in the recording liquid discharged by the first driving signal coincides with a phase of the second driving signal, namely, the phase of the recording liquid additionally discharged by the second driving signal, the recording liquid is efficiently supplied to the portion of the liquid column in the vicinity of the nozzle 61*b*, where the liquid column is becoming thinner.

Therefore, the control unit 40 that functions as the ink discharging control unit sets the time interval between the first driving signal and the second driving signal to be an integral multiple of the oscillation period of the residual oscillation. Then the condition for maintaining the shape of the liquid column is satisfied, if the above described condition for the oscillation period of the residual oscillation is satisfied.

Further, regarding the condition of the oscillation period of the residual oscillation, it is preferable that the time interval between the first driving signal and the second driving signal coincides with the oscillation period of the residual oscillation, so that the condition for maintaining the shape of the liquid column is well satisfied. This is because, it is preferable to supply the recording liquid by the second driving signal, prior to the liquid column becoming too thin, so as to maintain the fine shape of the liquid column.

For the condition of the oscillation period, it is not necessary that the time interval between the first driving signal and the second driving signal completely coincides with the oscillation period of the meniscus, or an integral multiple of the oscillation period of the meniscus. For example, there is a case in which the time interval between the first driving signal and the second driving signal is shifted by ±20% from the oscillation period, but a sufficient amount of the protons is generated per unit volume of the recording liquid. Therefore, it is assumed that setting the time interval between the first driving signal and the second driving signal, so as to coincide with the oscillation period of the meniscus or the integral multiple of the oscillation period of the meniscus, includes a shift in a range within which a sufficient amount of the protons is generated per unit volume of the recording liquid. The experiments described below confirm that, even if there is such a shift, a sufficient amount of the protons are generated per unit volume of the recording liquid.

The driving signal may be generated the same as the example shown in FIG. 6A. Additionally, the driving signal may be generated the same as examples shown in FIG. 6B through FIG. 6D. In the examples shown in FIGS. 6B and 6C, the second driving signal is generated soon after the first driving signal, so as not to reduce the pressure inside the nozzle 61*b*. In the example shown in FIG. 6D, the second driving signal is generated soon after the first driving signal, so as to reduce the pressure inside the nozzle 61*b*, and at the same time to supply the recording liquid to the thinning portion of the liquid column by using the reaction.

In each of FIG. 6A through FIG. 6D, the time interval between the first driving signal and the second driving signal is defined to be the time interval between a first corresponding portion of the first driving signal and a second corresponding portion of the second driving signal. Here, the first corresponding portions of the first signal in FIG. 6A through FIG. 6D correspond to each other, and the second corresponding portions of the second signal in FIG. 6A through FIG. 6D correspond to each other.

Further, the driving signal that causes the position of the meniscus to be placed outside the nozzle 61*b* during the time interval in which the bridge is formed is not limited to the combinations of the first signal and the second signal shown in FIG. 6A through FIG. 6D. Namely, the driving signal may be generated by an arbitrary waveform, provided that the driving signal causes the position of the meniscus to be placed outside the nozzle 61*b*, causes the electric resistance of the liquid column formed of the recording liquid to relatively decrease during a certain time interval, and causes an amount of protons per unit volume of the recording liquid to increase by increasing the amount of electrolysis per unit volume. Further, the second driving signal may be generated plural times and utilized, within a range in which the generated plural second driving signals satisfy the above conditions.

It is confirmed whether images are successfully formed by the following experiments, in which the above conditions are considered. The conditions of the experiments are as follows.

The image forming device that was used for the experiments is an image forming device that is modified "Inkjet Printer GX 5000 (produced by Ricoh Company, Ltd.)" having the same configuration as that of the image forming device 100. The intermediate transfer body 37 includes an aluminum element tube as the support body 37*a*, and a silicone rubber layer as the surface layer 37*b* that covers outer circumferential surface of the aluminum element tube. The silicone rubber layer has volume resistivity of 1.6 Ω·cm and thickness of 0.5 mm. In the silicone rubber layer carbon particles are dispersed. The intermediate transfer body 37 is rotationally driven in the A1 direction. A linear velocity of the outer circumference of the intermediate transfer body was 100 mm/s.

The distance between the heads 61Y, 61M, 61C, and 61BK and the intermediate transfer body 37 was set to 100 μm. The voltage to be applied between the intermediate transfer body 37 and the heads 61Y, 61M, 61C, and 61BK was set to 200 V (as described below, in some cases, the value was different). The transfer roller 38 was formed of a rubber layer having thickness of 5 mm and a core bar formed of a metal that was surrounded by the rubber layer. As the cleaning unit 34, a blade formed of a fluororubber was utilized. Further, the current sensor 35 and the temperature sensors 62 were arranged in the image forming device as described above.

Figure 7:
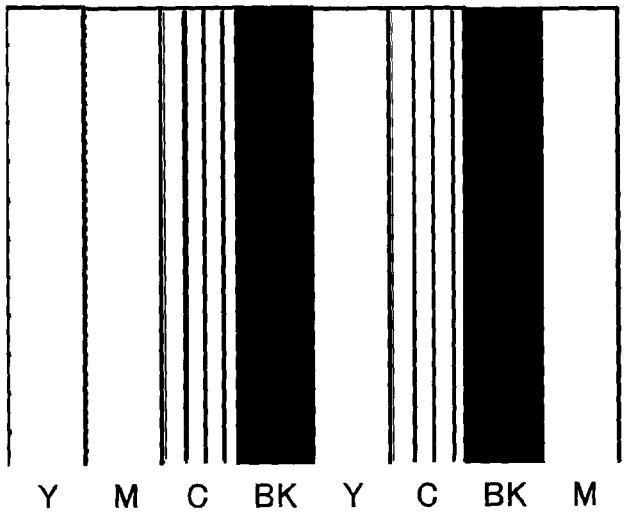
FIG. 7 is a conceptual diagram of an evaluation pattern which was used in experiments to confirm whether an image is properly formed.

In the experiments, the heads 61Y, 61M, 61C, and 61BK were not moved in the longitudinal direction of the intermediate transfer body 37, namely, in the direction perpendicular to the A1 direction, which was the direction perpendicular to the paper surface of FIG. 1, and the heads 61Y, 61M, 61C, and 61BK were fixed and utilized. As shown in FIG. 1, the heads 61Y, 61M, 61C, and 61BK were arranged at positions, which were shifted relative to each other in the A1 direction. The heads 61Y, 61M, 61C, and 61BK included plural nozzles 61*b*, respectively. However, in the experiments, the recording liquids were discharged from selected nozzles 61*b*, so that blurring could be evaluated as described below. FIG. 7 shows a conceptual diagram of a discharging pattern, that was an image pattern, namely, a pattern for the evaluation that was formed during the experiments. The discharging pattern formed in the experiments was made by repetition of 8 lines, in which the neighboring lines had different colors from each other. The evaluation described below was performed based on the result of forming the discharging pattern.

As the recording liquids, the liquids described below were used.

<Yellow Recording Liquid>

Sulfonic acid group coupled-type yellow pigment dispersion liquid (CAB-O-JET-270Y, the solid content: 10% by mass, produced by Cabot Corporation): 40% by mass Triethylene glycol: 15.0% by mass Glycerin: 25.0% by mass Propylene glycol mono-butyl ether: 0.9% by mass Hydrophobically modified polyether urethane (corresponding to the ABA-type amphiphilic polymers: produced by ADEKA Corporation): 0.75% by mass Potassium laurate (corresponding to the carboxylic acid-based surfactant): 0.5% by mass Dehydroacetic acid soda: 0.1% by mass Distilled water: residual quantity After these components were mixed, the resultant liquid was adjusted to have a pH level of 9.1 by adding 5% by mass of solution of lithium hydroxide, and subjected to pressure filtration by a membrane filter having an average pore size of 0.8 μm.

<Magenta Recording Liquid>

Sulfonic acid group coupled type magenta pigment dispersion liquid (CAB-O-JET-260M, the solid content: 10% by mass, produced by Cabot Corporation): 40.0% by mass Diethylene glycol: 20.0% by mass Propylene glycol monobutyl ether: 0.9% by mass Hydrophobically modified polyether urethane (corresponding to the ABA-type amphiphilic polymers: produced by ADEKA Corporation): 0.75% by mass Potassium laurate (corresponding to the carboxylic acid-based surfactant): 0.5% by mass Dehydroacetic acid soda: 0.1% by mass Distilled water: residual quantity After these components were mixed, the resultant liquid was adjusted to have a pH level of 9.1 by adding 5% by mass of solution of lithium hydroxide, and subjected to pressure filtration by a membrane filter having an average pore size of 0.8 μm.

<Cyan Recording Liquid>

Sulfonic acid group coupled type cyan pigment dispersion liquid (CAB-O-JET-250C, the solid content: 10% by mass, produced by Cabot Corporation): 40.0% by mass Ethylene glycol: 4.0% by mass Triethylene gloycol: 14.0% by mass Propylene glycol monobutyl ether: 0.9% by mass Hydrophobically modified polyether urethane (corresponding to the ABA-type amphiphilic polymers: produced by ADEKA Corporation): 0.75% by mass Potassium laurate (corresponding to the carboxylic acid-based surfactant): 0.5% by mass Dehydroacetic acid soda: 0.1% by mass Distilled water: residual quantity After these components were mixed, the resultant liquid was adjusted to have a pH level of 9.1 by adding 5% by mass of solution of lithium hydroxide, and subjected to pressure filtration by a membrane filter having an average pore size of 0.8 μm.

<Black Recording Liquid>

Sulfonic acid group coupled type carbon black pigment dispersion liquid (CAB-O-JET-200, the solid content 20% by mass, produced by Cabot Corporation): 35.0% by mass 2-pyrolidone: 10.0% by mass Glycerin: 14.0% by mass Propylene glycol monobutyl ether: 0.9% by mass Hydrophobically modified polyether urethane (corresponding to the ABA-type amphiphilic polymers: produced by ADEKA Corporation): 0.75% by mass Potassium laurate (corresponding to the carboxylic acid-based surfactant): 0.5% by mass Dehydroacetic acid soda: 0.1% by mass Distilled water: residual quantity After these components were mixed, the resultant liquid was adjusted to have a pH level of 9.1 by adding 5% by mass of solution of lithium hydroxide, and subjected to pressure filtration by a membrane filter having an average pore size of 0.8 μm.

The image forming device 100 that satisfies the above conditions of the experiments is the image forming device 100 according to a first embodiment. The evaluation procedures in the experiments are as follows.

(1) From each of the heads 61Y, 61M, 61C, and 61BK, a single dot line image is output along the A1 direction. In the heads 61Y, 61M, 61C, and 61BK, the discharging frequency is set to 1000 Hz, and the discharging time is set to 1 second.

(2) Ricoh Business Gross court (the transfer paper; product of Ricoh Company, Ltd.) is conveyed between the intermediate transfer body 37 and the transfer roller 38. An image formed of electrically-conductive recording liquids, which has been formed on the intermediate transfer body 37 at step (1) described above, is transferred onto the transfer paper, and the blurring is evaluated.

In the first embodiment, the time interval between the first driving waveform and the second driving waveform was varied, and the waveform amplitude of the second driving waveform was varied. In this manner, the plural conditions described in Table 1 below were generated. In the Table 1, the result of the blurring evaluation and the electric charge per unit volume of the recording liquid are summarized for each condition. Here, the condition 2 and the condition 22 are the same, and the results are the same.

Regarding the conditions indicated in Table 1, the waveform amplitude of the first driving waveform was fixed to 14 V. Further, it was confirmed from measurements that the oscillation periods of the meniscuses of the corresponding head 61Y, 61M, 61C, and 61BK were about 8 μs. Here, such oscillation periods may be calculated from the structures of the heads and the nozzles. Further, the voltage applied between the intermediate transfer body 37 and the heads 61Y, 61M, 61C, and 61BK by the voltage apply unit 33 was 0 V, only for the condition 27. For other conditions, the applied voltage was 200 V, as described above.

In the evaluation results indicated in Table 1, "the blurring" was evaluated by observing the boundary portions among the recording liquids in the corresponding colors using a microscope. The evaluation criteria were as follows.

| | |
|---|---|
| Boundary portions were very clear | 3 |
| Boundary portions were clear | 2 |
| There were some blurs, but negligible | 1 |
| Colors of the lines were mixed, and the original colors were not clear | 0 |

In the evaluation results indicated in Table 1, the numerical values corresponding to "the electric charge per unit volume of the recording liquid" were obtained by the following procedures.

(1) The head 61BK output 192 lines of the single dot line images along the A1 direction at 1000 Hz for one second. Then the current was measured using the current sensor 35. The measured current was converted into an electric charge that flowed through one dot of the recording liquid. Then the electric charges are integrated and an amount of charge is obtained.

(2) The heads 61BK output the 192 lines of single dot line images to a saucer (not shown) in the A1 direction at 1000 Hz for 1 minute. Then the weight of the recording liquid received by the saucer was measured. Based on the measured weight, a volume of the recording liquid per dot was calculated.

(3) For each condition, (the electric charge flowed through one dot)/(the volume of the recording liquid per dot) was calculated, based on the electric charge flowed through one dot obtained in the step (1) and the volume of the recording liquid per dot obtained in the step (2).

TABLE 1

| | Condition | | Results | |
|---|---|---|---|---|
| | Time interval between first driving waveform and second driving waveform | Waveform amplitude of second driving waveform | Blur | Electric charge per unit volume of recording liquid |
| Condition 1 | 7 μs | 6 V | 3 | 425 [C/L] |
| Condition 2 | 8 μs | 6 V | 3 | 489 [C/L] |
| Condition 3 | 9 μs | 6 V | 3 | 448 [C/L] |
| Condition 4 | 10 μs | 6 V | 3 | 401 [C/L] |
| Condition 5 | 11 μs | 6 V | 2 | 330 [C/L] |
| Condition 6 | 12 μs | 6 V | 2 | 260 [C/L] |
| Condition 7 | 13 μs | 6 V | 2 | 299 [C/L] |
| Condition 8 | 14 μs | 6 V | 2 | 331 [C/L] |
| Condition 9 | 15 μs | 6 V | 3 | 392 [C/L] |
| Condition 10 | 16 μs | 6 V | 3 | 405 [C/L] |
| Condition 11 | 17 μs | 6 V | 3 | 377 [C/L] |
| Condition 12 | 18 μs | 6 V | 2 | 300 [C/L] |
| Condition 13 | 19 μs | 6 V | 2 | 252 [C/L] |
| Condition 14 | 20 μs | 6 V | 2 | 237 [C/L] |
| Condition 15 | 21 μs | 6 V | 2 | 246 [C/L] |
| Condition 16 | 22 μs | 6 V | 2 | 297 [C/L] |
| Condition 17 | 23 μs | 6 V | 2 | 322 [C/L] |
| Condition 18 | 24 μs | 6 V | 3 | 354 [C/L] |
| Condition 19 | 25 μs | 6 V | 2 | 288 [C/L] |
| Condition 20 | 8 μs | 2 V | 2 | 351 [C/L] |
| Condition 21 | 8 μs | 4 V | 3 | 416 [C/L] |
| Condition 22 | 8 μs | 6 V | 3 | 489 [C/L] |
| Condition 23 | 8 μs | 8 V | 2 | 259 [C/L] |
| Condition 24 | 8 μs | 10 V | 2 | 283 [C/L] |
| Condition 25 | 8 μs | 12 V | 2 | 268 [C/L] |
| Condition 26 | 8 μs | 0 V | 1 | 213 [C/L] |
| Condition 27 | 8 μs | 0 V | 0 | 0 [C/L] |

From Table 1, the effect of inputting the second driving signal on the blurring can be confirmed. Further, by comparing the electric charges per unit volume of the recording liquid, it can be confirmed that the above effect is based on an increase of electric charge per unit volume, which is caused by using the second driving signal.

Further, by comparing the conditions for which the blurs are "3" with the conditions for which the blurs are "2", it can be confirmed that when the time interval between the first driving waveform and the second driving waveform coincides with an integral multiple of the oscillation period of the meniscus, or, when the time interval between the first driving waveform and the second driving waveform is close to an integral multiple of the oscillation period of the meniscus, the electric charge per unit volume of the recording liquid increases and the property of preventing the blurring is improved.

Especially, for the conditions 2 and 22, in which the time interval between the first driving waveform and the second driving waveform coincides with the oscillation period of the meniscus, the increment amount of the electric charge per unit volume of the recording liquid becomes maximum. Thus it can be understood that the most effective way for preventing the blurring is to cause the time interval between the first driving waveform and the second driving waveform to coincide with the oscillation period of the meniscus.

Therefore, it is preferable to set the time interval between the first driving waveform and the second driving waveform, so that the time interval coincides with the oscillation period of the meniscus or an integral multiple of the oscillation period of the meniscus. Here, as described above, the oscillation period of the meniscus is determined by measurements or calculations.

In addition, by comparing the condition 26 and other conditions, it can be confirmed that the application of the voltage between the intermediate transfer body 37 and the heads 61Y, 61M, 61C, and 61BK by the voltage apply unit 33 has an effect of preventing the blurring.

Further, for the conditions 23 through 25, since the amplitude of the second driving signal is large, the additionally discharged recording liquid, which was discharged by the second driving signal, adhered onto the intermediate transfer body 37. Therefore, the amounts of the charges per unit volume were relatively small values.

Second Embodiment

In a second embodiment, the control unit 40 determines and generates a driving signal in accordance with a table indicating a correspondence between the temperature and the driving signal, which has been prepared in advance and stored in a memory, based on the temperature measured by the temperature sensor 62, in addition to the conditions described in the first embodiment.

In the second embodiment, the pulse amplitude of the first driving signal and the pulse amplitude of the second driving signal are varied, depending on the measured temperature. Table 2 is the table stored in the memory and indicating the correspondence between the measured temperature and the amplitudes of the first driving signal and the second driving signal.

Here, the amplitudes of the first driving signal and the amplitudes of the second driving signal are adjusted, so that the discharged volumes and the amounts of the electric charge per unit volume of the recording liquid become substantially constant. When the measured temperature is not listed in the table, the temperature closest to the measured temperature is selected among the listed temperatures, and the amplitude of the first driving signal and the amplitude of the second driving signal are determined, based on the selected temperature.

TABLE 2

| Temperature | Amplitude of first driving signal | Amplitude of second driving signal |
|---|---|---|
| 10 degrees in Celsius | 15.5 V | 7.5 V |
| 15 degrees in Celsius | 15.0 V | 7.0 V |
| 20 degrees in Celsius | 14.5 V | 6.5 V |
| 25 degrees in Celsius | 14.0 V | 6.0 V |
| 30 degrees in Celsius | 13.5 V | 5.0 V |
| 35 degrees in Celsius | 13.0 V | 4.0 V |

In the second embodiment, as described above, the amplitudes of the first driving signal and the second driving signal are utilized as controlling parameters for determining the driving signal. However, the second embodiment is not limited to this, and at least one of a pulse width and the voltage of the first driving signal, a pulse width and the voltage of the second driving signal, and the time interval between the first driving signal and the second driving signal may be utilized as the controlling parameter.

In this manner, the position of the meniscus may be located outside the nozzle 61*b*, irrespectively of the environmental temperature, by determining the driving waveform in accordance with the physical properties of the recording liquid that are changed by the environmental temperature. Here, the temperature of the recording liquid is substantially measured and the driving waveform is determined by using the measured temperature. With this, the electric resistivity of the liquid column formed of the recording liquid is relatively reduced during a certain time interval, and the decomposed amount per unit volume of the recording liquid is increased. Therefore, an amount of the protons per unit volume of the recording liquid is increased, and high quality images can be formed.

Third Embodiment

In the third embodiment, the control unit 40 determines and generates the driving waveform by using the maximum amount of the current, based on the currents measured with the current sensor 35, in addition to the conditions explained in the first embodiment. The control unit 40 extracts the maximum amount of the current among the electric currents measured by the current sensor 35, during the idle discharging, prior to forming an image. The control unit 40 utilizes the extracted maximum amount of the current, so as to determine the driving signal. Here, the driving signal for performing the idle discharging is the first driving signal with the amplitude of 16 V. The second driving signal is not utilized for the driving signal for performing the idle discharging. The control unit 40 converts the maximum amount of the current into the value per one dot.

The control unit 40 determines and generates the driving signal in accordance with a table indicating a correspondence between the maximum amount of the current and the driving signal. Here, the table is prepared in advance, and stored in the memory. Table 3 is the table stored in the memory and indicating the correspondence between the maximum amount of the current and the amplitudes of the first driving signal and the second driving signal.

Here, the amplitudes of the first driving signal and the amplitudes of the second driving signal are adjusted, so that the discharged volumes and the amounts of the electric charge per unit volume of the recording liquid become substantially constant. When the maximum amount of the current is not listed in the table, the current value corresponding to the amount of the current closest to the maximum amount of the current is selected, and the amplitude of the first driving signal and the amplitude of the second driving signal are determined, based on the selected current value.

TABLE 3

| Maximum current | Amplitude of first driving signal | Amplitude of second driving signal |
|---|---|---|
| 150 [μA] | 15.5 V | 7.5 V |
| 180 [μA] | 15.0 V | 7.0 V |
| 210 [μA] | 14.5 V | 6.5 V |
| 230 [μA] | 14.0 V | 6.0 V |
| 250 [μA] | 13.5 V | 5.0 V |
| 270 [μA] | 13.0 V | 4.0 V |

As described above, in the third embodiment, the maximum amount of the current is utilized as the information for determining the driving signal. In order to obtain the information about the maximum amount of the current, the control unit 40 may operate using the measured results of the current sensor 35 and extract the information about the maximum amount of the current. Then the control unit 40 may determine the driving signal in accordance with the table indicating the correspondence between the maximum amount of the current and the driving signal. Except for the maximum amount of the current, at least one of the charge amount that is the integrated current amount, a time period during which the current flows, and a time interval between a time at which the piezoelectric element starts moving and a time at which the current starts flowing may be utilized as the value to be extracted.

In this manner, the electric current flowing across the bridge of the liquid column can be measured, and the driving waveform can be determined by the measured electric current. With this, the driving waveform can be determined depending on the waveform of the current indicating the shape the liquid column. Further, the position of the meniscus can be placed outside the nozzle 61*b* during the time interval in which the bridge is formed, and the electric resistivity of the liquid column formed of the recording liquid may be relatively reduced, during a certain time interval. Thus the decomposed amount per unit volume of the recording liquid can be increased. Therefore, an amount of the protons per unit volume of the recording liquid can be increased, and high quality images can be formed.

Figure 8:
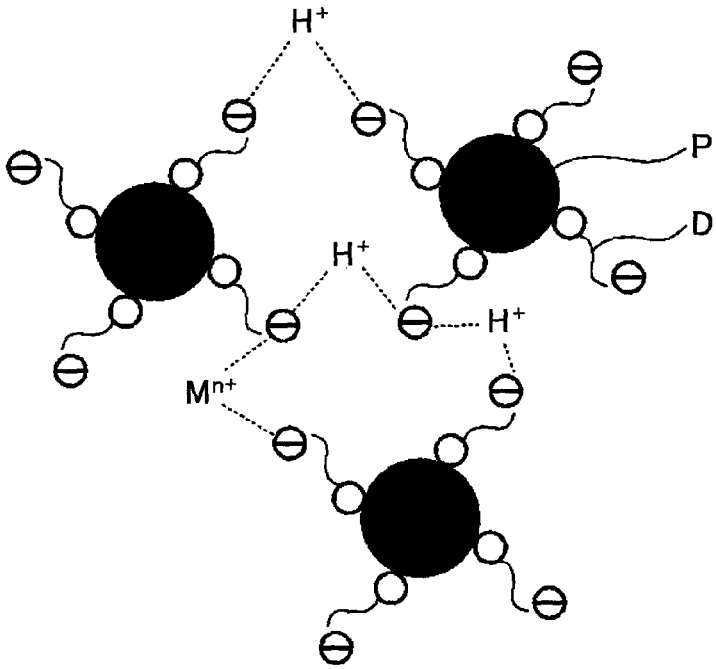
FIG. 8 is a conceptual diagram showing a state such that the pigments included in the electrically-conductive recording liquid discharged from the head condense through protons and metal cations, in an image forming device in which a surface of an intermediate transfer body is formed of a metal.

Here, in the configuration in which the intermediate transfer body 37 does not include the surface layer 37*b* and only includes the support body 37*a*, the support body 37*a* functions as the anode, as described above. In such a case, the support body 37*a*, which is a metal, may be oxidized together with the water on the surface of the support body 37*a*. When the support body 37*a*, which is the metal, is oxidized, metal cations are generated. The metal cations have an effect for condensing the colorant. Therefore, as shown in FIG. 8, the pigments P dispersed by the anionic dispersant D are condensed through the protons and the metal cations ($M^{n+}$) and the cohesiveness of the pigments P is increased.

Figure 9:
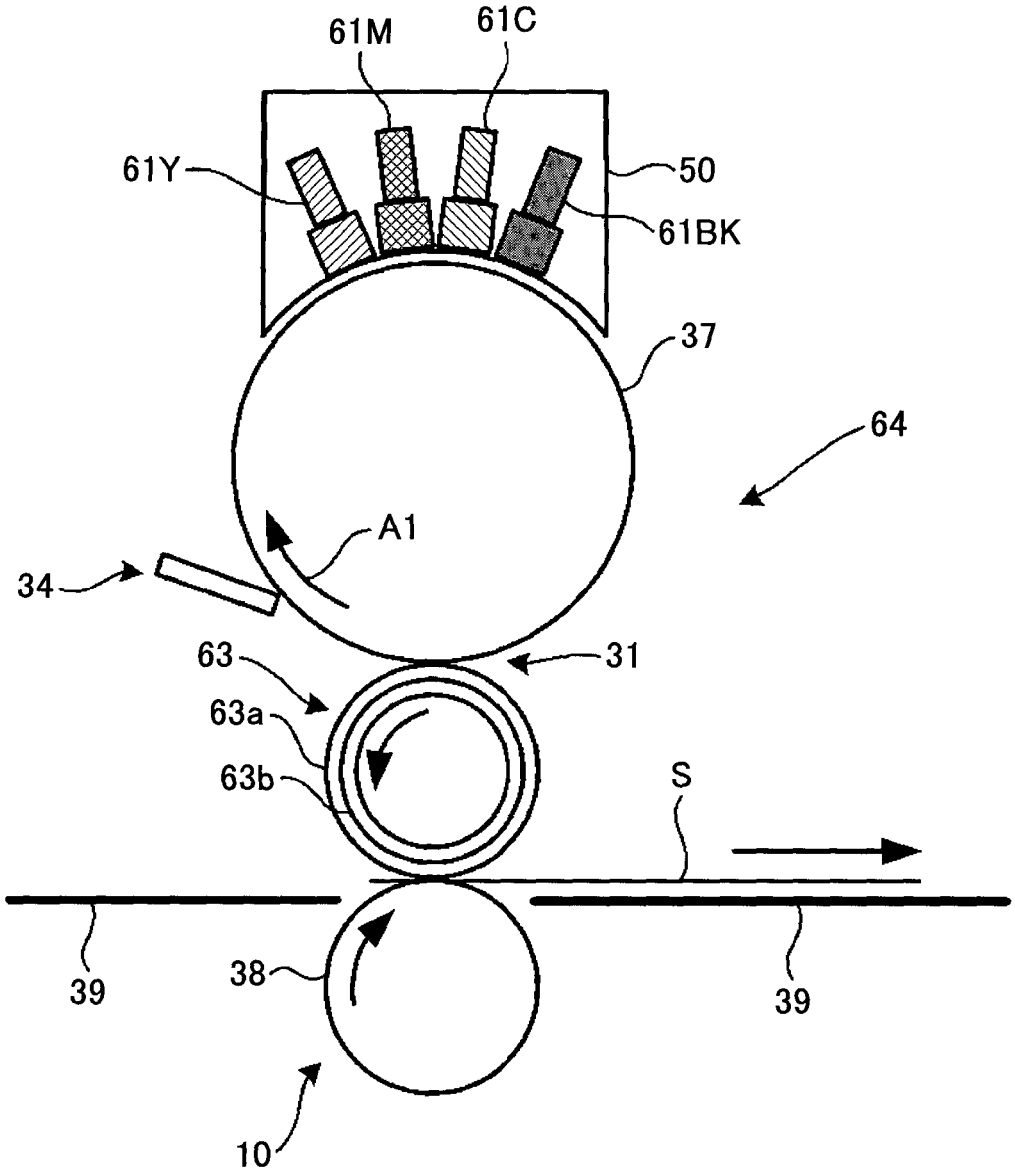
FIG. 9 is a schematic front view showing an example of a configuration of the image forming device having a transfer image supporting body, whose surface is formed of an elastic body, in the image forming device in which the surface of the intermediate transfer body is formed of the metal.

In such a configuration, as shown in FIG. 9, it is preferable that the transfer unit 64 includes an intermediate transfer drum 63, in addition to the transfer roller 38. The intermediate transfer drum 63 is a transfer image supporting body, whose surface including a rubber layer 63*a* as an elastic body layer that temporarily supports the image that is formed on the intermediate transfer body 37 and transferred onto the elastic body. The intermediate transfer drum 63 is rotationally driven by the rotation of the intermediate transfer body 37. The transfer roller 38 is rotationally driven by the rotation of the intermediate transfer drum 63. Since the surface of the intermediate transfer drum 63 is formed of the elastic body, images are well transferred from the intermediate transfer body 37, which is formed of the metal and whose surface hardness is high, onto the intermediate transfer drum 63. Thus the transferability of the transfer unit 64 is improved.

The intermediate transfer drum 63 includes the rubber layer 63*a* and a substrate 63*b* covered with the rubber layer 63*a*. The material of the substrate 63*b* is not particularly limited. However, as the material of the substrate 63*b*, a metal such as aluminum, an alloy of aluminum, copper, and a stainless steel may be considered. The material of the rubber layer 63*a* is not particularly limited. However, as the material of the rubber layer 63*a*, for example, a silicone rubber, a urethane rubber, and a fluororubber may be considered.

Incidentally, the control unit 40 stores an image forming program for executing an image forming method in the memory. In the image forming method, the heads 61Y, 61M, 61C, and 61BK; the intermediate transfer body 37; the voltage apply unit 33; the transfer unit 64; and the control unit 40 are utilized. The heads 61Y, 61M, 61C, and 61BK include the corresponding nozzles 61*b* that discharge the corresponding recording liquids in accordance with a driving signal. The recording liquids discharged from the corresponding heads 61Y, 61M, 61C, and 61BK are applied onto the intermediate transfer body 37. At least the surface of the intermediate transfer body 37 is electrically conductive. The voltage apply unit 33 is for applying an voltage between the intermediate transfer body 37 and the heads 61Y, 61M, 61C, and 61BK, so as to decompose the recording liquids by electrolysis. Here, the recording liquids are discharged from the corresponding heads 61Y, 61M, 61C, and 61BK and temporarily bridge between the intermediate transfer body 37 and the corresponding heads 61Y, 61M, 61C, 61BK. The transfer unit 64 transfers images formed of the recording liquids and supported on the intermediate transfer body 37 onto the transfer paper S. The control unit 40 functioning as the discharging control unit generates the driving signal. The driving signal causes the recording liquids to be discharged from the corresponding nozzles 61Y, 61M, 61C, and 61BK. Further, in the image forming method, the control unit 40 functioning as the discharging control unit generates the driving signal that causes the positions of the meniscuses of the corresponding recording liquids to be placed outside the corresponding nozzles 61*b*, during the time interval in which the corresponding recording liquids temporarily bridge between the intermediate transfer body 37 and the corresponding heads 61Y, 61M, 61C, and 61BK. In this manner, the control unit 40 performs the image formation. In this regard, the control unit 40 or the memory functions as an image forming program storing unit. Such an image forming program may be stored in a semiconductor medium (e.g., a ROM, or a non-volatile memory), an optical medium (e.g., a DVD, a MO, a MD, or a CD-R), a magnetic medium (e.g., a hard disk, a magnetic tape, or a flexible disk), or the like, in addition to the memory included in the control unit 40. When such a memory or the like stores the image forming program, the memory or the like forms a non-transitory computer readable recording medium that stores the image forming program.

The preferred embodiments are described above. However, the present invention is not limited to the specifically disclosed embodiments, and variations and modifications may be made without departing from the scope of the present invention.

For example, the pigments included in the electrically-conductive recording liquid may be dispersed by a cationic dispersant, and the pigments may be condensed through hydroxide ions generated on the surface of the intermediate transfer body 37, which functions as the cathode. It is not necessary that the whole intermediate transfer body 37 is electrically conductive. For example, only the surface of the transfer body 37 may be electrically conductive.

The image forming device according to any of the above described embodiments is not limited to the above described type. It can be another type of image forming device. For example, the head may be a shuttle type head. Further, the image forming device may be a copier, a facsimile machine, a combined machine thereof, or a monochrome combined machine thereof. Furthermore, the image forming machine may be an image forming device that is utilized for forming electric circuits, or an image forming device that is utilized for forming predetermined images in the field of biotechnology. The number of the heads may be varied depending on the usage of the image forming device. For example, the image forming device may only include one head. Alternatively, the image forming device may include plural heads.

The effects described in the embodiments of the present invention merely enumerate suitable effects arising from the embodiments of the present invention, and the effects of the embodiments are not limited to the above described effects.

The present application is based on Japanese Priority Applications No. 2011-091414 filed on Apr. 15, 2011, and No. 2011-289354 filed on Dec. 28, 2011, the entire contents of which are hereby incorporated herein by reference.

The invention claimed is:

1. An image forming device, comprising:

a head comprising a nozzle that discharges an electrically-conductive recording liquid in accordance with a driving signal;

an intermediate transfer body on which the recording liquid is applied, wherein at least a surface of the intermediate transfer body is electrically conductive;

a voltage apply unit that applies a voltage between the intermediate transfer body and the head, so as to decompose the recording liquid by electrolysis, wherein the recording liquid is in a state in which the recording liquid temporarily bridges between the head and the intermediate transfer body;

a transfer unit that transfers an image onto a recording material, wherein the image is formed of the recording liquid and supported on the intermediate transfer body; and a discharging control unit that generates the driving signal causing the recording liquid to be discharged from the nozzle, wherein the discharging control unit generates the driving signal so that a meniscus is placed outside the nozzle during a time interval in which the recording liquid is in the state, said device further comprising:

a current measurement unit that measures a current flowing across the recording liquid in the state, wherein the discharging control unit generates the driving signal based on the current measured by the current measurement unit.

2. The image forming device according to claim 1, wherein the discharging control unit generates, a first driving signal that causes the recording liquid to be in the state and a second driving signal that causes the recording liquid to be additionally discharged from the nozzle during the state.

3. The image forming device according to claim 2, wherein the discharging control unit generates the second driving signal so that the recording liquid subsequently returns to the nozzle.

4. The image forming device according to claim 1, further comprising:

a temperature measurement unit that measures temperature of the head or temperature in a vicinity of the head, wherein the discharging control unit generates the driving signal based on the temperature measured by the temperature measurement unit.

5. The image forming device according to claim 1, wherein:

the recording liquid comprises:

water as a solvent, and pigments dispersed by an anionic dispersant; and the intermediate transfer body functions as an anode when the voltage is applied to the intermediate transfer body by the voltage apply unit.

6. The image forming device according to claim 5, wherein the anionic dispersant comprises a polymeric dispersant.

7. The image forming device according to claim 5, wherein the anionic dispersant comprises a low molecular weight anionic dispersing agent.

8. The image forming device according to claim 1, wherein the recording liquid is alkaline.

9. The image forming device according to claim 1, wherein the recording liquid comprises a water-soluble organic solvent as a moisturizing agent.

10. The image forming device according to claim 1, wherein the recording liquid has a viscosity of from 2 mPa·s to 8 mPa·s when the recording liquid is discharged from the nozzle.

11. The image forming device according to claim 1, wherein the recording liquid has a surface tension of from 20 mN/m to 50 mN/m, and an electric conductivity of from 0.02 S/m to 1 S/m.

12. The image forming device according to claim 1, wherein the discharging control unit sets a time interval between the first driving signal and the second driving signal so that the time interval becomes an integral multiple of an oscillation period of the meniscus at the nozzle.

13. The image forming device according to claim 12, wherein the discharging control unit sets the time interval between the first driving signal and the second driving signal so that the time interval coincides with the oscillation period of the meniscus at the nozzle.

14. An image forming method, comprising causing the image forming device of claim 1 to form an image by:

discharging an electrically-conductive recording liquid in accordance with a driving signal, wherein the recording liquid is discharged from a head comprising a nozzle;

applying the recording liquid on an intermediate transfer body, wherein at least a surface of the intermediate transfer body is electrically conductive;

applying a voltage between the intermediate transfer body and the head, so as to decompose the recording liquid by electrolysis, wherein the voltage is applied via a voltage apply unit and the recording liquid is in a state in which the recording liquid temporarily bridges between the head and the intermediate transfer body;

transferring an image onto a recording material, wherein the image is transferred via a transfer unit, and the image is formed of the recording liquid and supported on the intermediate transfer body; and generating the driving signal that causes the recording liquid to be discharged from the nozzle, wherein an image is formed by generating the driving signal by a discharging control unit so that a meniscus is placed outside the nozzle during a time interval in which the recording liquid is in the state.

15. An image forming device, comprising:

a head comprising a nozzle that discharges an electrically-conductive recording liquid in accordance with a driving signal;

an intermediate transfer body on which the recording liquid is applied, wherein at least a surface of the intermediate transfer body is electrically conductive;

a voltage apply unit that applies a voltage between the intermediate transfer body and the head, so as to decompose the recording liquid by electrolysis, wherein the recording liquid is in a state in which the recording liquid temporarily bridges between the head and the intermediate transfer body;

a transfer unit that transfers an image onto a recording materials, wherein the image is formed of the recording liquid and supported on the intermediate transfer body; and a discharging control unit that generates the driving signal causing the recording liquid to be discharged from the nozzle, wherein the discharging control unit generates the driving signal so that a meniscus is placed outside the nozzle during a time interval in which the recording liquid is in the state, wherein the discharging control unit generates, a first driving signal that causes the recording liquid to be in the state and a second driving signal that causes the recording liquid to be additionally discharged from the nozzle during the state, and wherein the discharging control unit sets a time interval between the first driving signal and the second driving signal so that the time interval becomes an integral multiple of an oscillation period of the meniscus at the nozzle.

16. The image forming device according to claim 15, wherein the discharging control unit sets the time interval between the first driving signal and the second driving signal so that the time interval coincides with the oscillation period of the meniscus at the nozzle.

* * * * *